US007939488B2

(12) United States Patent
Scheuing et al.

(10) Patent No.: US 7,939,488 B2
(45) Date of Patent: May 10, 2011

(54) NATURAL DISINFECTING CLEANERS

(75) Inventors: David R. Scheuing, Pleasanton, CA (US); Rui Zhang, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 12/717,706

(22) Filed: Mar. 4, 2010

(65) Prior Publication Data

US 2010/0160201 A1 Jun. 24, 2010

Related U.S. Application Data

(63) Continuation-in-part of application No. 12/558,795, filed on Sep. 14, 2009, which is a continuation-in-part of application No. 12/343,202, filed on Dec. 23, 2008, now Pat. No. 7,618,931, which is a continuation-in-part of application No. 12/198,677, filed on Aug. 26, 2008, now Pat. No. 7,608,573, and a continuation-in-part of application No. 12/198,685, filed on Aug. 26, 2008, now Pat. No. 7,629,305.

(51) Int. Cl.

| | |
|---|---|
| ***C11D 3/22*** | (2006.01) |
| ***C11D 1/68*** | (2006.01) |
| ***C11D 1/62*** | (2006.01) |
| ***C11D 1/75*** | (2006.01) |

(52) U.S. Cl. ..... 510/340; 510/319; 510/330; 510/331; 510/342; 510/350; 510/351; 510/360; 510/382; 510/384; 510/426; 510/433; 510/437; 510/474; 510/481; 510/492; 510/499; 510/503

(58) Field of Classification Search ..... 510/319, 510/330, 331, 340, 342, 350, 351, 360, 382, 510/384, 426, 433, 437, 474, 481, 492, 499, 510/503

See application file for complete search history.

(56) References Cited

U.S. PATENT DOCUMENTS

| | | | | |
|---|---|---|---|---|
| 4,587,266 | A | 5/1986 | Verdicchio | |
| 4,919,837 | A | 4/1990 | Gluck | |
| 5,308,611 | A | 5/1994 | Thompson | |
| 5,624,704 | A | 4/1997 | Raad et al. | |
| 5,719,113 | A | 2/1998 | Fendler | |
| 5,902,283 | A | 5/1999 | Raad | |
| 6,004,915 | A | 12/1999 | Elliott | |
| 6,060,440 | A | 5/2000 | Sackariasen | |
| 6,117,820 | A | 9/2000 | Cutler | |
| 6,121,228 | A | 9/2000 | Drapier | |
| 6,242,009 | B1 | 6/2001 | Bataresh | |
| 6,267,979 | B1 | 7/2001 | Raad | |
| 6,509,319 | B1 | 1/2003 | Raad | |
| 6,531,434 | B1 | 3/2003 | Gluck | |
| 6,537,960 | B1 | 3/2003 | Ruhr | |
| 6,686,323 | B2 | 2/2004 | Nilsson | |
| 6,759,382 | B2 | 7/2004 | Ahmed | |
| 6,939,566 | B2 | 9/2005 | Bataresh | |
| 7,066,916 | B2 | 6/2006 | Keaty | |
| 7,163,914 | B2 | 1/2007 | Gluck | |
| 7,166,563 | B2 * | 1/2007 | Woodhead | 510/237 |
| 7,511,006 | B2 | 3/2009 | Shimmin | |
| 2003/0078242 | A1 | 4/2003 | Raad | |
| 2004/0230168 | A1 | 11/2004 | Keaty | |
| 2005/0013836 | A1 | 1/2005 | Raad | |
| 2005/0118240 | A1 | 6/2005 | Shalaby | |
| 2005/0233938 | A1 | 10/2005 | Delplancke | |
| 2005/0276795 | A1 | 12/2005 | Batarseh | |
| 2006/0100128 | A1 | 5/2006 | McCue | |
| 2006/0172889 | A1 | 8/2006 | Barnes | |
| 2006/0258541 | A1 | 11/2006 | Crews | |
| 2007/0048345 | A1 | 3/2007 | Huang | |
| 2007/0154621 | A1 | 7/2007 | Raad | |
| 2009/0054294 | A1 | 2/2009 | Theiler | |

FOREIGN PATENT DOCUMENTS

| | | |
|---|---|---|
| EP | 0987321 | 1/2006 |
| EP | 1618877 | 1/2006 |
| WO | WO 98/53036 | 11/1998 |
| WO | WO 00/49095 | 8/2000 |
| WO | WO 00/62618 | 10/2000 |
| WO | WO 03/028762 | 4/2003 |
| WO | WO 2005/084627 | 9/2005 |
| WO | WO 2009/007166 | 1/2009 |
| WO | WO 2009/024747 | 2/2009 |
| WO | WO 2010/027608 * | 3/2010 |

* cited by examiner

*Primary Examiner* — Brian P Mruk

(74) *Attorney, Agent, or Firm* — Alok Goel

(57) ABSTRACT

A cleaning composition with a limited number of natural ingredients contain a hydrophobic syndetic, a hydrophilic syndetic, and a biguanide or a cationic quaternary ammonium salt. The cleaning composition can be used to clean laundry, soft surfaces, and hard surfaces and cleans as well or better than commercial compositions containing synthetically derived cleaning agents.

18 Claims, No Drawings

NATURAL DISINFECTING CLEANERS

CROSS-REFERENCES TO RELATED APPLICATIONS

This application is a continuation-in-part of application of U.S. Ser. No. 12/558,795, filed on Sep. 14, 2009, now allowed, which is a continuation-in-part of U.S. Ser. No. 12/343,202, filed on Dec. 23, 2008, and now U.S. Pat. No. 7,618,931, which is a continuation-in-part of both applications U.S. Ser. No. 12/198,677 and U.S. Ser. No. 12/198,685, now U.S. Pat. No. 7,608,573, and U.S. Pat. No. 7,629,305 respectively, both filed on Aug. 26, 2008, all of which are incorporated herein by reference.

BACKGROUND OF THE INVENTION

1. Field of the Invention

The present invention relates generally to naturally based cleaners. Natural based cleaners include, but are not limited to, laundry detergents, soil and stain removers, light duty liquid detergents, all-purpose cleaners, and glass cleaners.

2. Description of the Related Art

Cleaning formulations have progressed and created a large chemical industry devoted to developing new synthetic surfactants and solvents to achieve ever improving cleaning compositions for the consumer. Recently, consumers have shown an increasing interest in natural and sustainable products. Obstacles in selling such products include the expense to the consumer, since many conventional cleaners typically cost half as much as natural products or products based on sustainable materials. Another inconvenience to consumers of such products includes the limited distribution of natural products, which are often found only in specialty stores. Finally, there remains a significant gap in the performance of natural products, relative to that of highly developed formulations based on synthetic surfactants and solvents which are produced from petrochemical feedstocks. Companies marketing natural or sustainable consumer products have had difficulty in formulating cleaners that deliver acceptable consumer performance, while utilizing only a limited number of natural and/or sustainably produced components.

Typical cleaning formulations require multiple surfactants, solvents, and builder combinations to achieve adequate consumer performance. Because of the increased cost of synthetic sources for cleaning agents and a concern for the environment, there is a renewed focus on using materials that are naturally sourced.

Increasing numbers of consumers are seeking cleaning products that not only are more natural or sustainable, but which also exhibit better overall safety of use. Consumers prefer products that can be readily used around children and pets, in convenient forms such as pre-loaded disposable wipes or ready to use sprays, but these safer and more sustainable products still are expected to deliver performance on many attributes, such as cleaning and reduction of germs, at parity to traditional products.

Cationic quaternary ammonium compounds are commonly used in household disinfecting products. However, these materials can be irritating to the skin and eyes. There are several biguanides, such as the salts of chlorhexidine (CH) or salts of certain polymeric biguanides such as poly(hexamethylene biguanide) (PHMB) that exhibit relatively low dermal irritation. Although cleaning compositions incorporating biguanides are known, (e.g., U.S. Pat. No. 6,841,527) they generally contain significant levels of solvents and/or surfactants that are derived from petrochemical sources. A significant amount of art has addressed how to deliver disinfecting formulations that also meet the aesthetic hurdles set by consumers, such as good cleaning, the delivery of fragrances, and low residues or streaking on household surfaces using solvents, surfactants and polymers that are derived from petrochemical sources. Thus, the delivery of disinfecting cleaning formulations with good performance and aesthetics, coupled with improved user safety profiles, (for example, milder to the skin or eyes) and a simultaneous reduced impact on the environment, due to the use of a limited set of natural or sustainable materials, remains a major challenge.

For example, U.S. Pat. No. 6,759,382 to Ahmed discloses a concentrated liquid detergent composition containing a primary surfactant system chosen from alkylbenzene sulfonate or another sulfate or sulfonate, and a secondary surfactant system containing an $\alpha$-sulfomethyl ester or alkyl polyglucoside, where the alkyl polyglucoside is a $C_8$ to $C_{16}$ alkyl polyglucoside, a $C_8$ to $C_{10}$ alkyl polyglucoside, a $C_8$ to $C_{14}$ alkyl polyglucoside, a $C_{12}$ to $C_{14}$ alkyl polyglucoside, or a $C_{12}$ to $C_{16}$ alkyl polyglucoside. U.S. Pat. No. 6,686,323 to Nilsson et al. discloses $C_6$, $C_8$ and $C_{10}$ alkyl polyglucosides as surfactant for mud removal in oil drilling. U.S. Pat. No. 6,117,820 to Cutler et al. discloses agricultural formulations containing $C_8$ to $C_{10}$ alkyl polyglucosides, $C_9$ to $C_{11}$ alkyl polyglucosides, and 2-ethyl-1-hexylglucoside. U.S. Pat. App No. 20060172889 to Barnes et al. discloses agricultural formulations containing $C_7$ to $C_{18}$ alkyl polyglucosides. U.S. Pat. No. 6,537,960 to Ruhr et al. discloses $C_6$ and $C_8$ alkyl polyglucosides in highly alkaline formulations with amine oxides and alcohol alkoxylates. PCT App. No. WO 00/49095 to Landeweer et al. discloses $C_6$ to $C_{10}$ alkyl polyglucosides with glycol ethers such as butyl diglycol.

Prior art compositions do not combine safe, effective cleaning and antimicrobial efficacy with a minimum number of ingredients, especially with natural ingredients. It is therefore an object of the present invention to provide a cleaning composition that overcomes the disadvantages and obstacles associated with prior art cleaning compositions.

SUMMARY OF THE INVENTION

In accordance with the above objects and those that will be mentioned and will become apparent below, one aspect of the present invention comprises a natural cleaning composition consisting essentially of: a. a hydrophilic syndetic selected from the group consisting of $C_6$ alkyl polyglucoside, $C_6$ to $C_8$ alkyl polyglucoside, $C_8$ alkyl polyglucoside, $C_4$ to $C_8$ alkyl polypentoside and combinations thereof; b. a hydrophobic syndetic selected from an amine oxide; c. a biguanide compound or a cationic quaternary ammonium salt, or mixtures thereof; d. optionally, an organic chelating agent from the group consisting of 2-hydroxyacids, 2-hydroxyacid derivatives, glutamic acid, glutamic acid derivatives, gluconate, and mixtures thereof; e. optionally a solvent selected from the group consisting of propylene glycol, 1,3-propanediol, ethanol, sorbitol, glycerol, and combinations thereof; f. optionally, an anionic surfactant selected from the group consisting of sodium lauryl sulfate, sodium alkyl $\alpha$-sulfomethyl ester, and combinations thereof; g. optionally a nonionic surfactant selected from the group consisting of alkyl polyglucosides having chain lengths greater than $C_8$, and combinations thereof; and h. optional ingredients selected from pH adjusting agents, builders, calcium salts, boric acid or borate, enzymes, dyes, colorants, fragrances, preservatives, fluorescent whitening agents, bluing agents, defoamers, bleaches, thickeners, anti-redeposition polymers, salts of EDTA, DTPA, GLDA, EDDS, TMG, Tiron and combinations thereof.

In accordance with the above objects and those that will be mentioned and will become apparent below, another aspect of the present invention comprises a natural cleaning composition consisting essentially of: a. a hydrophilic syndetic selected from the group consisting of $C_6$ alkyl polyglucoside, $C_6$ to $C_8$ alkyl polyglucoside, $C_8$ alkyl polyglucoside, $C_6$ alkyl sulfate, $C_6$ to $C_8$ alkyl sulfate, $C_8$ alkyl sulfate, $C_4$ to $C_8$ alkyl polypentoside and combinations thereof; b. a hydrophobic syndetic selected from the group consisting of an amine oxide, a fatty acid, a fatty alcohol, a sterol, a sorbitan fatty acid ester, a glycerol fatty acid ester, a polyglycerol fatty acid ester, a $C_{14}$ to $C_{22}$ alkyl polypentoside and combinations thereof; c. a biguanide compound or a cationic quaternary ammonium salt, or mixtures thereof; d. optionally, an organic chelating agent from the group consisting of 2-hydroxyacids, 2-hydroxyacid derivatives, glutamic acid, glutamic acid derivatives, gluconate, and mixtures thereof; e. optionally a solvent selected from the group consisting of propylene glycol, 1,3-propanediol, ethanol, sorbitol, glycerol and combinations thereof; f. optionally a nonionic surfactant selected from the group consisting of an alkyl polyglucoside having chain lengths from $C_{10}$ to $C_{20}$, a $C_8$ to $C_{14}$ alkyl polypentoside, alkyldiethanolamide, alkylethanolamide, an alkyl poly(glycerol ether) and combinations thereof; g. optionally, an anionic surfactant selected from the group consisting of a fatty alcohol sulfate, an alkyl $\alpha$-sulfomethyl ester, and combinations thereof; h. optionally an amphoteric surfactant selected from the group consisting of sarcosinate, tauride, betaine, sulfobetaine and combinations thereof; and i. optional ingredients selected from pH adjusting agents, calcium salts, boric acid, enzymes, dyes, colorants, fragrances, preservatives, fluorescent whitening agents, blueing agents, defoamers, bleaches, thickeners, anti-redeposition polymers, salts of EDTA, DTPA, GLDA, EDDS, TMG, Tiron and combinations thereof.

In accordance with the above objects and those that will be mentioned and will become apparent below, another aspect of the present invention comprises a natural cleaning composition comprising a. a hydrophilic syndetic selected from the group consisting of $C_6$ alkyl polyglucoside, $C_6$ to $C_8$ alkyl polyglucoside, $C_8$ alkyl polyglucoside, $C_6$ alkyl sulfate, $C_6$ to $C_8$ alkyl sulfate, $C_8$ alkyl sulfate, $C_4$ to $C_8$ alkyl polypentoside and combinations thereof; b. a hydrophobic syndetic selected from the group consisting of an amine oxide, a fatty acid, a fatty alcohol, a sterol, a sorbitan fatty acid ester, a glycerol fatty acid ester, a polyglycerol fatty acid ester, a $C_{14}$ to $C_{22}$ alkyl polypentoside, and combinations thereof; c. a biguanide compound or a cationic quaternary ammonium salt, or mixtures thereof; d. optionally a solvent selected from the group consisting of propylene glycol, 1,3-propanediol, ethanol, sorbitol, glycerol, and combinations thereof; e. optionally a nonionic surfactant selected from the group consisting of an alkyl polyglucoside having chain lengths from $C_{10}$ to $C_{20}$, alkyldiethanolamide, alkylethanolamide, an alkyl (polyglycerol) ether, a $C_8$ to $C_{14}$ alkyl polypentoside, and combinations thereof; f. optionally an amphoteric surfactant selected from the group consisting of sarcosinate, tauride, betaine, sulfobetaine and combinations thereof; g. optionally, an anionic surfactant selected from the group consisting of a fatty alcohol sulfate, an alkyl $\alpha$-sulfomethyl ester, and combinations thereof; h. optionally an organic chelating agent from the group consisting of 2-hydroxyacids, 2-hydroxyacid derivatives, glutamic acid, glutamic acid derivatives, gluconate, and mixtures thereof; and i. optional ingredients selected from pH adjusting agents, calcium salts, boric acid, enzymes, dyes, colorants, fragrances, preservatives, fluorescent whitening agents, blueing agents, defoamers, bleaches, thickeners, anti-redeposition polymers, DTPA, GLDA, EDDS, TMG, Tiron and combinations thereof, wherein the composition does not contain alkyl glycol ethers, alcohol alkoxylates, alkyl monoglycerolether sulfate, alkyl ether sulfates, alkanolamines, alkyl ethoxysulfates, phosphates, EDTA, linear alkylbenzene sulfonate ("LAS"), linear alkylbenzene sulphonic acid ("HLAS") or nonylphenol ethoxylate ("NPE") or soluble metal ions selected from the group of silver, copper, or zinc, triclosan, p-chlorometaxylenol or iodine, pentose alcohols and their isomers, D-xylitol and its isomers, D-arabitol and its isomers, aryl alcohols, benzyl alcohol, phenoxyethanol, or homopolymers of the monomers diallyl dimethyl ammonium chloride or ethylene imine.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition. Each of the noted cleaner composition components is discussed in detail below.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes cationic, anionic, nonionic, zwitterionic, amphoteric agents and/or combinations thereof.

The term "base surfactant", as used herein, refers to a surfactant or amphiphile that exhibits a strong tendency to adsorb at interfaces in a relatively ordered fashion, oriented perpendicular to the interface.

The term "syndetic" (meaning to join or link together, as in mixing water and oil), as used herein, refers to a relatively weak amphiphile which exhibits a significant ability to adsorb at an oil-water interface (from either the water phase, hence a "hydrophilic syndetic", or from the oil phase, hence a "hydrophobic syndetic") only when the interface already bears an adsorbed layer of a base surfactant or mixture of base surfactants. Adsorption of syndetics at oil-water interfaces is thought to affect the spacing and/or the order of the adsorbed ordinary surfactants in a manner that is highly beneficial to the production of very low oil-water interfacial tensions, which in turn increases the solubilization of oils and/or the removal of oils from solid surfaces.

The term "Interfacial Tension ("IFT")" refers to the excess surface free energy of the molecules residing at the interface of two immiscible phases, e.g., an aqueous phase and an oily phase, relative to that of the bulk phase(s). The concept of IFT is well known to those skilled in the art, and has been extensively discussed in references, such as C. A. Miller, P. Neogi: Interfacial Phenomena—Equilibrium and Dynamic Effects, 2nd. Ed., Surfactant Science Series, Vol. 139, 2007, CRC Press.

The term "Renewable Carbon Index ("RCI")" refers to the fraction (or percentage) of the carbon atoms in the average structure of, for example, an anionic surfactant, hydrophilic syndetic, hydrophobic syndetic or optionally a solvent which are derived from feedstocks other than petroleum or natural gas. Typically, and desirably, when such components of cleaners are produced from natural materials or in a sustainable manner, the RCI will be in excess of 0.75 or "75%", due to the use of materials found in nature, or to the use of feedstocks derived from sustainable sources such as plants, fungi or algae, products of bacterial fermentation processes, or products of treatments of plant-, fungal- or algae-derived biomass. The major challenges in the formulation of cleaners with desirably high RCIs are the selection of a few suitable materials that are economically viable, while delivering performance that is as good as or better than the conventional products.

The term "total syndetics" refers to the sum of the weight percentages of hydrophilic syndetics and hydrophobic syndetics in a composition.

The term "total base surfactant" refers to the sum of the weight percentages of anionic surfactant, and any applicable nonionic, amphoteric or cationic surfactants in the composition.

The term "comprising", which is synonymous with "including," "containing," or "characterized by," is inclusive or open-ended and does not exclude additional, unrecited elements or method steps. See MPEP 2111.03. See, e.g., *Mars Inc.* v. *H.J. Heinz Co.,* 377 F.3d 1369, 1376, 71 USPQ2d 1837, 1843 (Fed. Cir. 2004) ("like the term 'comprising,' the terms 'containing' and 'mixture' are open-ended.") *Invitrogen Corp.* v. *Biocrest Mfg., L.P.,* 327 F.3d 1364, 1368, 66 USPQ2d 1631, 1634 (Fed. Cir. 2003) ("The transition 'comprising' in a method claim indicates that the claim is open-ended and allows for additional steps."); *Genentech, Inc.* v. *Chiron Corp.,* 112 F.3d 495, 501, 42 USPQ2d 1608, 1613 (Fed. Cir. 1997) See MPEP 2111.03. ("Comprising" is a term of art used in claim language which means that the named elements are essential, but other elements may be added and still form a construct within the scope of the claim.); *Moleculon Research Corp.* v. *CBS, Inc.,* 793 F.2d 1261, 229 USPQ 805 (Fed. Cir. 1986); *In re Baxter,* 656 F.2d 679, 686, 210 USPQ 795, 803 (CCPA 1981); *Ex parte Davis,* 80 USPQ 448, 450 (Bd. App. 1948). See MPEP 2111.03.

The term "consisting essentially of" as used herein, limits the scope of a claim to the specified materials or steps "and those that do not materially affect the basic and novel characteristic(s)" of the claimed invention. *In re Herz,* 537 F.2d 549, 551-52, 190 USPQ 461, 463 (CCPA 1976) (emphasis in original).

The term "consisting of" as used herein, excludes any element, step, or ingredient not specified in the claim. *In re Gray* 53 F.2d 520, 11 USPQ 255 (CCPA 1931); *Ex Parte Davis,* 80 USPQ 448, 450 (Bd. App. 1948). See MPEP 2111.03.

The term "natural" as used herein is meant to mean at least 95% of the components of the product are derived from plant and mineral based materials. Also, the "natural" product is biodegradable. Additionally, the "natural" product is minimally toxic to humans and has a LD50>5000 mg/kg. The "natural" product does not contain of any of the following: non-plant based ethoxylated surfactants, linear alkylbenzene sulfonates ("LAS"), ether sulfates surfactants or nonylphenol ethoxylate (NPE).

The term "ecofriendly" as used herein is meant to mean at least 99% of the components of the product are derived from plant and mineral based materials. Also, the "ecofriendly" product is biodegradable. Additionally, the "ecofriendly" product is minimally toxic to humans and has a LD50>5000 mg/kg. The "ecofriendly" product does not contain of any of the following: non-plant based ethoxylated surfactants, linear alkylbenzene sulfonates ("LAS"), ether sulfates surfactants or nonylphenol ethoxylate (NPE).

The term "biodegradable" as used herein is meant to mean microbial degradation of carbon containing materials. The "biodegradable" material must be tested under a recognized protocol and with tested methods of established regulatory bodies such as: EPA, EPA-TSCA, OECD, MITI or other similar or equivalent organizations in the US or internationally. Suitable non-limiting examples of test methods for biodegradation include: OECD methods in the 301-305 series. Generally, all "biodegradable" material must meet the following limitations:

a) removal of dissolved organic carbon >70% b) biological oxygen demand (BOD) >60% c) % of BOD of theoretical oxygen demand >60% d) % CO2 evolution of theoretical >60%

Syndetics Technology

In one embodiment, the compositions can contain an anionic surfactant as a base surfactant, a hydrophilic syndetic, and a hydrophobic syndetic. Alternately, the compositions can contain an anionic surfactant as a base surfactant, a hydrophilic syndetic, a hydrophobic syndetic and a solvent. Alternately, the compositions can contain an anionic surfactant and a nonionic surfactant as a total base surfactant mixture, a hydrophilic syndetic, a hydrophobic syndetic and a solvent. Alternately, the compositions can contain an anionic surfactant and an amphoteric surfactant as a total base surfactant mixture, a hydrophilic syndetic, a hydrophobic syndetic and a solvent. Alternately, the compositions can contain an anionic surfactant, a nonionic surfactant, and an amphoteric surfactant as a total base surfactant mixture, a hydrophilic syndetic, a hydrophobic syndetic and a solvent.

Alternately, the compositions can contain a nonionic surfactant as the base surfactant, a hydrophilic syndetic, a hydrophobic syndetic, and a solvent. Alternately, the compositions can contain a nonionic surfactant as the base surfactant, a hydrophilic syndetic and a hydrophobic syndetic. Alternately, the compositions can contain a nonionic and amphoteric surfactants as the base surfactant, a hydrophilic syndetic and a hydrophobic syndetic.

In another embodiment, the compositions can contain a cationic surfactant as a base surfactant, a hydrophilic syndetic, and a hydrophobic syndetic. Alternately, the compositions can contain a cationic surfactant as a base surfactant, a hydrophilic syndetic, a hydrophobic syndetic and a solvent. Alternately, the compositions can contain a cationic surfactant and a nonionic surfactant as a total base surfactant mixture, a hydrophilic syndetic, a hydrophobic syndetic and a solvent. Alternately, the compositions can contain a cationic surfactant and a nonionic surfactant as a total base surfactant mixture, a hydrophilic syndetic, and a hydrophobic syndetic. Alternately, the compositions can contain a cationic surfactant and an amphoteric surfactant as a total base surfactant mixture, a hydrophilic syndetic, a hydrophobic syndetic and a solvent. Alternately, the compositions can contain a cationic surfactant and an amphoteric surfactant as a total base surfactant mixture, a hydrophilic syndetic, a hydrophobic syndetic. Alternately, the compositions can contain a cationic surfactant and an anionic surfactant as a total base surfactant mixture, a hydrophilic syndetic, a hydrophobic syndetic and a solvent. Alternately, the compositions can contain a cationic surfactant and an anionic surfactant as a total base surfactant mixture, a hydrophilic syndetic, a hydrophobic syndetic. Alternately, the compositions can contain a cationic surfactant, an anionic surfactant, a nonionic surfactant, and an amphoteric surfactant as a total base surfactant mixture, a hydrophilic syndetic, a hydrophobic syndetic and a solvent.

One key component of the invention is the short-chain hydrophilic syndetic, which can rapidly adsorb at the interface between a water-immiscible oil and water, together with the base surfactant or surfactant mixture, resulting in very low IFT values, which are important for good detergency performance. The short-chain hydrophilic syndetic is preferably a $C_6$ alkyl polyglucoside, a $C_6$ to $C_8$ alkyl polyglucoside, or a $C_8$ alkyl polyglucoside. Alternative suitable hydrophilic syndetics are $C_6$ alkyl sulfate or $C_6$ to $C_8$ alkyl sulfate. Another alternative suitable hydrophilic syndetic is a $C_4$ to $C_8$ alkyl polypentoside, an example of which is Radia®Easysurf 6505. The alkyl polypentosides are materials of desirably high RCI in which the hydrophilic groups are derived from raw material sources such as wheat bran and straw. Such biomass-based sources, when refined, yield syrups that are enriched in pentoses, or 5 carbon sugars, such as arabinose and xylose. Glycosylation of pentoses with alcohols is readily accomplished, adding the hydrophobic alkyl groups which endow the resulting materials with interfacial activity. Preferably, the alkyl chains are derived from fatty alcohols which are derived from a natural source, such as coconut or palm oil, or sugar beets, or distilled cuts of fatty alcohols from such plant-based raw materials. Condensation reactions between the hydrophilic pentoses may occur during synthesis of the interfacially active materials, thus producing practical final materials that can be described as alkyl polypentosides. Suitable alkylpentosides are described in for example, in U.S. Pat. No. 5,688,930. Herein, we refer to glycosylated pentoses and their mixtures as alkyl pentosides, alkyl xylosides or alkyl polypentosides. In order for these materials to function as hydrophilic syndetics, the alkyl chains should be relatively short, that is the average length of the chain should be from about 4 to 8 carbon atoms.

It can sometimes be especially advantageous, in formulations containing alkyl polyglucosides or alkyl polypentosides as nonionic surfactants to exploit the fact that some of these nonionic surfactants, which typically contain a distribution of alkyl chain lengths, contain sufficient amounts of either C6 to C8 alkyl polyglucosides or C4 to C8 polypentosides such that they can function as a source of a hydrophilic syndetic, as well as the source of the nonionic base surfactant. The use of such alkyl polyglucosides or alkyl polypentosides can decrease manufacturing complexity in terms of the number of raw materials required for production of the natural cleaners, but in addition can reduce or even eliminate the need for extensive refining or fractionation of these raw materials, increasing the flexibility of biomass feedstock materials used, reducing the energy consumption used in their production and distribution, reducing waste stream volumes, and thereby reducing the environmental impact of the entire supply chain for the cleaning formulations. As taught herein, adjustment of the ratios of the hydrophilic syndetic, nonionic surfactant, and hydrophobic syndetic can readily be done to achieve better detergency performance, or improved efficiency of solubilization of desirable oils such as fragrances, or lower total active levels suitable for low filming and streaking properties, or even the antimicrobial efficacy of a biocide which might be present.

A second key component is the hydrophobic syndetic, which can interact with the other components, including the oil and the total base surfactant or total base surfactant mixture. The incorporation of both hydrophilic and hydrophobic syndetics in formulations has been found to be highly beneficial in delivering formulations that can decrease the IFT between an aqueous solution and oily substances commonly encountered as "soils" by consumers. The incorporation of both hydrophilic and hydrophobic syndetics in formulations has also been found to be highly beneficial in delivering rapid reduction of the IFT, especially on the timescales relevant to consumer-perceived performance of the cleaner. For example, the incorporation of the syndetics has been found to enable reduction of the IFT values on timescales of 15 minutes or less, which is quite relevant to the laundering of garments via machines. As is well known in the art, the removal of oily substances from surfaces by cleaning formulations proceeds via either the so-called "roll-up" of oil, or "snap-off" of oil, or true "solubilization" of oil. The efficiency of all of these processes is improved by the reduction of IFT.

In the formulation of cleaners that are used by the consumer without dilution, such as ready to use hard surface cleaners or cleaners loaded onto a substrate such as a nonwoven, sponge, etc., the reduction in IFT, delivered via syndetic systems, between the aqueous solution and water-immiscible oils such as fragrance oils or natural solvents such as limonene is also highly desirable, since the formulations can be adjusted to deliver typical concentrations of these oils at lower total surfactant concentration. Without being bound by theory, the use of syndetic systems gives a route to formulations that efficiently dissolve desirable oils such as fragrances with significantly lower environmental impact due to reduced raw material usage and the use of surfactants that are sustainable, i.e, are of desirably high RCI.

In the case of ready to use cleaners delivered to surfaces via, for example, a trigger sprayer or via a cleaning lotion loaded onto a substrate such as a nonwoven or sponge, the ratio of the cleaning composition to the amount of oily soil to be removed can be highly variable, and is often higher than in the case of cleaning compositions used via dilution into a container of water, or via dilution into water in a machine, such as a typical home washing machine. In addition, it is known that a significant amount of the removal of oily soils from surfaces with ready to use cleaners or with lotions loaded onto substrates such as nonwovens is due to a combination of mechanical scrubbing forces, locally high shear rate conditions, and efficient wetting of the soiled surface being cleaned by the cleaning composition. Soil removal in these cases must be accomplished without the benefit of a true "washing bath", as is present in a home washing machine. In addition to the absence of a washing bath, the cleaning of surfaces with ready to use products also must occur on very rapid time scales, since the cleaning composition is applied to the surface to be cleaned and then is immediately spread (typically within seconds) and removed, with little or no rinsing of the surface. In the absence of significant rinsing of the surfaces being cleaned, it is well known in the art that the formulation should be adjusted to minimize residues on the cleaned surfaces (often described as minimizing "filming" and/or "streaking" of the cleaner on the surfaces cleaned). Applicants have now found that the use of a hydrophilic syndetic, a hydrophobic syndetic, and a base surfactant that can be either an anionic or nonionic surfactant in ready to use formulations is advantageous in ready to use formulations. The presence of the syndetics in ready to use formulations increases the solubilization of both "desirable" oils such as fragrance oils and natural solvents as well as oily soils (such as canola oil or motor oil). However, due to the particular cleaning kinetics, cleaner/oil ratios, and extent of rinsing associated with the use of these cleaners, as described above, Applicants have found that the anionic base surfactant is advantageously reduced, eliminated, or replaced by a nonionic base surfactant, to yield significant reductions in residues (reduced filming/streaking), reduced total actives of the formulations (and thus reduced environmental impact), and reduced levels of or even elimination of solvents, especially volatile solvents such as ethanol.

Formulations with excellent antimicrobial activity when used on hard surfaces are known which contain chlorhexidine gluconate (CHG) and very high concentrations (about 70%) of volatile solvents such as ethanol. Even though ethanol from natural sources is available, many consumers seeking natural or more sustainable disinfecting cleaners in ready to use forms find such high concentrations of ethanol or other volatile solvents objectionable for aesthetic or environmental reasons. Without being bound by theory, Applicants believe that the roles of alcohol in such disinfecting formulations include a reduction in the surface tension of the formulation, which affects the wetting and spreading of the formulations on inanimate surfaces, and also a reduction in the interfacial tension (IFT) between the formulation and the surfaces of microbes, such as bacteria, fungi, and viruses, which reduction is beneficial to the antimicrobial performance of the CHG molecules. The antimicrobial effectiveness of formulations employing syndetics in combination with biocides, with little or no alcohol present, is believed to be due to the effective rapid reduction in the IFT between the formulations and the surfaces of microbes in a manner similar to the reduction in IFT between aqueous formulations and water-immiscible oils. As described herein, adjustment of the relative amounts of hydrophilic and hydrophobic syndetics can be advantageously used to simultaneously optimize the antimicrobial performance, the aesthetic performance, the oil solubilization performance, and the environmental impact of ready to use formulations for consumers demanding such products.

Anionic Surfactant

In one embodiment of the invention, the anionic surfactant is a fatty alcohol sulfate having a $C_{12}$ or longer chain, for example sodium lauryl sulfate. Typical alkyl sulfate surfactants are water soluble salts or acids of the formula $ROSO_3M$ wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperidinium cations and quaternary ammonium cations derived from alkylamines such as ethylamine, diethylamine, triethylamine, and mixtures thereof, and the like).

In another embodiment of the present invention, the anionic surfactant is an α-sulfomethyl ester (MES). In a suitable embodiment, the α-sulfomethyl ester salt is an α-sulfomethyl ester of a fatty acid and can be chosen from a $C_{12}$-$C_{18}$ sodium methyl α-sulfomethyl ester and a $C_{12}$-$C_{18}$ disodium α-sulfo fatty acid salt. Because more than one α-sulfomethyl ester may be present, the present invention contemplates the use of both sodium methyl α-sulfomethyl ester and the disodium α-sulfo fatty acid salt in the secondary surfactant system. Commercially available sodium α-sulfomethyl esters that may be used in accordance with the present invention include ALPHA-STEP® ML-40 and ALPHA-STEP® MC-48, both sold by Stepan Company. A mixture of sodium methyl 2-sulfolaurate and disodium 2-sulfolaurate is preferred.

Other anionic materials include alkanoyl sarcosinates corresponding to the formula $R^1CON(CH_3)—CH_2CH_2—CO_2M$ wherein $R^1$ is a saturated or unsaturated, branched or unbranched alkyl or alkenyl group of about 10 to about 20 carbon atoms, and M is a water-soluble cation. Nonlimiting examples of which include sodium lauroyl sarcosinate, sodium cocoyl sarcosinate, and ammonium lauroyl sarcosinate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting, examples of which include sodium cocoyl lactylate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting examples of which include sodium cocoyl lactylate. Other anionic materials include acyl glutamates corresponding to the formula $R^1CO—N(COOH)—CH_2CH_2—CO_2M$ wherein $R^1$ is a saturated or unsaturated, branched or unbranched alkyl or alkenyl group of about 8 to about 24 carbon atoms, and M is a water-soluble cation. Nonlimiting examples include sodium lauroyl glutamate and sodium cocoyl glutamate. Also useful are taurates which are based on taurine, which is also known as 2-aminoethanesulfonic acid. Examples of taurates include N-alkyltaurines such as the one prepared by reacting dodecylamine with sodium isethionate according to the teaching of U.S. Pat. No. 2,658,072 which is incorporated herein by reference in its entirety. Other examples based of taurine include the acyl taurines formed by the reaction of n-methyl taurine with fatty acids (having from about 8 to about 24 carbon atoms). Other anionic surfactants include glutamates, such as sodium or triethylammonium cocoyl glutamate, and glycinates, such as potassium cocoyl glycinate.

Other anionic surfactants which can be useful in the formulation of an anionic base surfactant package include alkyl sulfosuccinates. Also useful are disodium coco polyglucose citrate, sodium cocopolyglucose tartrate, and disodium cocopolyglucose sulfosuccinate, all available from, for example, Jan Dekker (UK) Ltd.

Besides sodium, other salts can include, for example, potassium, ammonium, and substituted ammonium salts of the anionic surfactant. The anionic surfactant is typically present in about 0.01 to about 50%, or about 0.01 to about 30%, or about 0.01 to about 20%, or about 0.01 to about 10.0%, or about 0.01 to about 5.0%, or about 0.01 to about 4.0%, or about 0.01 to about 3.0%, or about 0.01 to about 2.0% or about 0.01 to about 1.0%.

Nonionic Surfactant

In one embodiment of the invention, the cleaning compositions can optionally contain alkanol amides, and fatty acid amine surfactants. A suitable alkanolamide is a lower alkanolamide of a higher alkanoic acid, for example a mono-alkanolamide chosen from lauryl/myristic monoethanolamide and coco monoethanolamide from Stepan Company®.

In one embodiment of the invention, the compositions can optionally contain an alkyl pyrrolidone nonionic surfactant. An example of a suitable pyrrolidone is octyl pyrrolidone, which has a C8 alkyl chain.

In one embodiment of the invention, the cleaning compositions contain one or more alkyl polyglucoside surfactants. The alkyl polyglucoside surfactant preferably has a naturally derived alkyl substituent, such as coconut fatty alcohol or a distilled cut of a natural fatty alcohol. Examples of alkyl polyglucoside that function as a nonionic surfactant, include but are not limited to, such as a $C_{10}$ to $C_{20}$ alkylpolyglucoside, a $C_{10}$ to $C_{14}$ alkylpolyglucoside, a $C_{12}$ to $C_{14}$ alkylpolyglucoside, or a $C_{12}$ to $C_{16}$ alkylpolyglucoside.

Suitable alkyl polyglucoside surfactants are the alkyl polysaccharides that are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al., which are all incorporated by reference. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g., a polyglycoside (polyglucoside), hydrophilic group containing from about 1.3 to about 10, or from about 1.3 to about 3, or from about 1.3 to about 2.7 saccharide units. Typical hydrophobic groups include alkyl groups, either saturated or unsaturated, branched or unbranched containing from about 8 to about 18, or from about 10 to about 16, carbon atoms. Suitable alkyl polysaccharides are octyl, nonyl, decyl, undecyl, dodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

In another embodiment of the invention the cleaning compositions contain one or more alkyl polypentosides. The alkyl polypentoside preferably has an alkyl chain length greater than $C_8$ and less than about $C_{14}$ (i.e., $C_{10}$ to $C_{14}$ alkyl polypentoside). Suitable alkyl polypentosides include Radia®Easysurf 6781 (described as a $C_8$ to $C_{10}$ alkyl polypentoside, available from Oleon). Blends of alkyl polypentosides and alkyl polyglucosides, when used as the nonionic surfactant, can be particularly useful in adjustment of aesthetic parameters of formulations, such as viscosity or color.

Other suitable nonionic surfactants are the alkyl (poly glycerol ethers), in which more than one glycerol group is present. Particularly preferred are alkyl (poly glycerol ethers) in which the alkyl groups are derived from natural fatty alcohols, for example, from plant-based sources such as coconut oil, and the hydrophilic polyglycerol groups are derived from natural glycerine, which can be produced via an alkaline condensation reaction as described in U.S. Pat. No. 3,968,169. It is possible to employ mixtures of alkyl polyglucosides, alkyl polypentosides and alkyl poly (glycerol) ethers as the nonionic surfactant mixture in formulations, in combination with a hydrophilic syndetic, a hydrophobic syndetic, and an anionic base surfactant or anionic surfactant mixture, in order to optimize costs and certain aesthetic parameters such as viscosity or visual residues left on surfaces, depending on the manufacturing location utilized.

Suitably, the nonionic surfactant is present in the cleaning composition in an amount ranging from about 0.01 to about 30 weight percent, or about 0.1 to about 30 weight percent, or about 10 to about 30 weight percent, or about 1 to about 5 weight percent, or about 2 to about 5 weight percent, or about 0.5 to about 5 weight percent, or about 0.5 to about 4 weight percent, or about 0.5 to about 3 weight percent, or about 0.5 to about 2.0 weight percent, or about 0.1 to about 0.5 weight percent, or about 0.1 to about 1.0 weight percent, or about 0.1 to about 2.0 weight percent, or about 0.1 to about 3.0 weight percent, or about 0.1 to about 4.0 weight percent, or greater than 2 weight percent, or greater than 3 weight percent.

The cleaning compositions preferably have an absence of other nonionic surfactants, especially petroleum derived nonionic surfactants, such as nonionic surfactants based on synthetic alcohols or ethoxylates.

The present invention does not contain the following components: alkyl glycol ethers, alcohol alkoxylates, alkyl monoglycerolether sulfate, alkyl ether sulfates, alkyl ethoxysulfates, linear alkylbenzene sulfonate ("LAS"), linear alkylbenzene sulphonic acid ("HLAS"), nonylphenol ethoxylate ("NPE"), or phosphates.

Amphoteric Surfactants

The compositions can optionally contain amphoteric surfactants such as lecithin, alkyl betaines, alkyl sultaines, sulfobetaines, sarcosinates, taurides, alkyl amphoacetates, alkyl amphodiacetates, alkyl amphopropionates, and alkyl amphodipropionates. Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference.

Suitably, the amphoteric surfactant is present in the cleaning composition in an amount ranging from about 0.01 to about 30 weight percent, or about 0.1 to about 30 weight percent, or about 10 to about 30 weight percent, or about 1 to about 5 weight percent, or about 2 to about 5 weight percent, or about 0.5 to about 5 weight percent, or about 0.5 to about 4 weight percent, or about 0.5 to about 3 weight percent, or about 0.5 to about 2.0 weight percent, or about 0.1 to about 0.5 weight percent, or about 0.1 to about 1.0 weight percent, or about 0.1 to about 2.0 weight percent, or about 0.1 to about 3.0 weight percent, or about 0.1 to about 4.0 weight percent, or greater than 2 weight percent, or greater than 3 weight percent.

Hydrophilic Syndetic

In one embodiment of the invention the cleaning compositions contain one or more hydrophilic syndetics. Suitable short-chain hydrophilic syndetics include a $C_6$ alkyl polyglucoside, such as AG6206®, or a $C_6$ to $C_8$ alkyl polyglucoside, such as AG6202® from Akzo-Nobel® or $C_8$ alkyl polyglucoside. Other suitable short-chain hydrophilic syndetics include $C_6$ to $C_8$ alkyl sulfate, including hexyl sulfate, octyl sulfate, and 2-ethylhexyl sulfate. Other suitable hydrophilic syndetic includes, but are not limited to, a $C_4$ to $C_8$ alkyl polypentoside. The alkyl chains are preferably straight chains and derived from natural sources, rather than branched chains, such as 2-ethylhexyl.

Where an alkyl polyglucoside or alkyl sulfate ingredient contains $C_6$ and/or $C_8$ alkyl chain lengths in addition to higher alkyl chain lengths, the portion of the ingredient containing $C_6$ and/or $C_8$ alkyl chain lengths may be considered to represent a hydrophilic syndetic component of the invention; the higher alkyl chain length portion may then be considered to represent an anionic or nonionic surfactant component of the invention, as appropriate. For example, Glucopon 425® (a coconut alkyl polyglucoside having naturally derived components available from Cognis Corporation), Dow Triton® CG110 (a $C_8$-$C_{10}$ alkyl polyglucoside available from Dow Chemical Company), and Alkadet 15® or Alkadet 35® (a $C_8$-$C_{10}$ alkyl polyglucoside available from Huntsman Corporation) may be considered to contain both hydrophilic syndetic and nonionic surfactant components.

Suitably, hydrophilic syndetics are present in the cleaning composition in an amount ranging from about 0.01 to about 10 weight percent, or about 0.01 to about 5.0 weight percent, about 0.01 to about 4.0 weight percent, about 0.01 to about 3.0 weight percent, about 0.01 to about 2.0 weight percent, or about 0.01 to about 1.0 weight percent, or about 0.01 to about 0.5 weight percent, or about 0.01 to about 0.20 weight percent.

Hydrophobic Syndetic

In one embodiment of the invention the cleaning compositions contain one or more hydrophobic syndetics. Preferred hydrophobic syndetics are amine oxides. Suitable amine oxides include those compounds having the formula $$R^3(OR^4)_xNO(R^5)2$$

wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof-, x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$-$C_{18}$ alkyl dimethylamine oxide, and $C_{10}$-$C_{18}$ acylamido alkyl dimethylamine oxide. Preferred amine oxides include but are not limited to, dimethyl alkyl amine oxide, amidoamine oxide, diethyl alkyl amine oxide and combinations thereof. In a more preferred embodiment, the amine oxide has $C_{12}$-$C_{18}$ alkyl chains.

Other preferred hydrophobic syndetics include fatty acids, such as oleic or palmitic acid. A fatty acid is a carboxylic acid that is often with a long unbranched aliphatic tail (chain), which is saturated or unsaturated. Fatty acids are aliphatic monocarboxylic acids, derived from, or contained in esterified form in an animal or vegetable fat, oil or wax. Natural fatty acids commonly have a chain of 4 to 28 carbons (usually unbranched and even numbered), which may be saturated or unsaturated. Saturated fatty acids do not contain any double bonds or other functional groups along the chain. The term "saturated" refers to hydrogen, in that all carbons (apart from the carboxylic acid [—COOH] group) contain as many hydrogens as possible. In contrast to saturated fatty acids, unsaturated fatty acids contain double bonds. Examples of fatty acids that can be used in the present invention, include but are not limited to, butyric acid, caproic acid, caprylic acid, capric acid, lauric acid, myristic acid, palmitic acid, stearic acid, arachdic acid, behenic acid, lignoceric acid, myristoleic acid, palmitoleic acid, oleic acid, linoleic acid, alpha-linoleic acid, linolenic, arachidonic acid, eicosapentaenoic acid, erucic acid, docosahexaenoic acid or mixtures thereof. The fatty acid suitably has a primary chain length (the predominant chain length) from $C_{12}$-$C_{20}$.

Other suitable hydrophobic syndetics are glycerol fatty acid esters and sorbitan fatty acid esters. The glyceryl alkyl or alkenyl ester is preferably a monoester of a $C_8$-$C_{22}$ carboxylic acid with glycerol. A suitable example is CITHROL GML® which is glyceryl monolaurate. The sorbitan alkyl or alkenyl ester preferably contains from 8 to 22 carbon atoms in the ester group. An especially suitable sorbitan ester is a sorbitan monolaurate such as that available under the trade name SPAN 20®. Another suitable sorbitan ester is SPAN 80®. Other suitable hydrophobic syndetics are fatty alcohols, which are the reduction product of fatty acids. Other suitable hydrophobic syndetics are sterols, especially plant sterols such as campesterol, sitosterol, stigmasterol, lanosterol, avenasterol, and cycloartenol.

Other suitable hydrophobic syndetics are the polyglycerol fatty acid esters. The fatty acids are preferably from natural, plant-based sources, and preferably contain from about 8 to 22 carbon atoms. Particularly preferred are polyglycerol fatty acid esters in which the hydrophilic polyglycerol groups are derived from the condensation of glycerine of vegetable origin. Particularly preferred polyglycerols, which can be esterified to produce the polyglycerol fatty acid esters, are Diglycerol (INCI diglycerine) and Polyglycerol-3 (INCI polyglycerine-3) available from Solvay Chemicals. Commercial polyglycerols are typically heterogeneous mixtures of diglycerol, triglycerol, and higher oligomers, including components up to about decaglycerol, as well as additional cyclic isomers. Polyglycerols with reduced cyclic isomer content have been demonstrated to exhibit superior biodegradability, thus more readily enabling the formulation of eco-friendly cleaners containing polyglycerol fatty acid esters as the hydrophobic syndetic. In addition, without wishing to be bound by theory, applicants believe the kinetics of the reduction of IFT will be more rapid when there is less heterogeneity in the distribution of the polyglycerol groups of the polyglycerol fatty acid esters used as hydrophobic syndetics in the present invention. Nonlimiting examples of polyglycerol fatty acid esters suitable for use as hydrophobic syndetics include diglycerol monooleate, polyglycerol-3 monooleate, diglycerol monolaurate, polyglycerol-3 monolaurate, diglycerol stearate, polyglycerol-3 stearate, diglycerol monoricinoleate and polyglycerol-3 monoricinoleate.

Other suitable hydrophobic syndetics are the alkyl polypentosides in which the alkyl chain length is $C_{14}$ or greater, up to about $C_{22}$. A commercially available example of an alkyl polypentoside suitable as a hydrophobic syndetic is Radia®Easysurf 6669.

Suitably, hydrophobic syndetics are present in the cleaning composition in an amount ranging from about 0.01 to about 10 weight percent, or about 0.01 to about 5.0 weight percent, about 0.01 to about 4.0 weight percent, about 0.01 to about 3.0 weight percent, about 0.01 to about 2.0 weight percent, or about 0.01 to about 1.0 weight percent, or about 0.01 to about 0.5 weight percent, or about 0.01 to about 0.20 weight percent.

Base Surfactant

The term "base surfactant", as used herein, refers to a surfactant or amphiphile that exhibits a strong tendency to adsorb at interfaces in a relatively ordered fashion, oriented perpendicular to the interface. Anionic surfactants with hydrophobic tails longer than 10 carbon atoms and a charged ionic head group tend to act as base surfactants, as do anionic surfactants with two hydrophobic tails of at least 6 carbons each, such as di-hexyl or di-octyl sulfosuccinates. A base surfactant is able to facilitate the expansion of the interface between an aqueous solution and an oily substance due to its strong tendency to adsorb at the interface, which eliminates the direct contact (on the molecular size scale) between the aqueous solution and the oily substance or oily phase, which in turn is necessary for the removal of oily soils from, for example, fabrics in laundry applications. A well-known shortcoming of surfactants (amphiphiles) that exhibit a very strong ability to adsorb at interfaces (sometimes referred to as exhibiting "strong" amphiphilicity) is the tendency to interact with themselves, as well, thereby reducing the interaction between the aqueous solution and the surfactant. When the interaction between the aqueous phase and the "self-interacting" or "self-aggregated" surfactant is inadequate the surfactant forms a separate, sometimes ill-defined coacervate-like phase, a liquid crystal phase, a vesicle phase, or a mixture of these phases, and is hence no longer available for adsorption at the interface between the aqueous phase and the oily substance or oily soil phase, and hence the detergency performance is poor. In such cases, it is then important to adjust the "strength" of the amphiphilicity of the surfactant to bring it into a preferred range, thereby achieving improved cleaning performance. It was surprisingly found that combinations of hydrophilic and hydrophobic syndetics are able to provide the necessary adjustment, and that incorporation of syndetics provides a significant improvement in the overall detergency performance of formulations that are significantly more natural and/or sustainable than those used in products currently available.

Cationic quaternary ammonium biocides, and biguanide germicides (which also bear cationic charges in solution) such as the salts of chlorhexidine are known to be very active at oil-water and air-water interfaces, and thus are also considered to be surfactants. In the formulation of natural disinfecting cleaners in which syndetics are utilized to increase the overall detergency performance, and/or the solubilization of desirable oils such as fragrance oils or natural solvents such as limonene, the quaternary ammonium biocides and biguanide biocides can play the role of the "base surfactant" in the formulation, by analogy to the anionic base surfactants discussed above. In practical formulations containing these cationically charged base surfactants, they are incorporated primarily for their antimicrobial properties rather than their cleaning performance properties. Hence, in the formulation of natural systems containing at least one hydrophilic syndetic and at least one hydrophobic syndetic, the concentration of the cationic biocide can be fixed at a level that is consistent with good antimicrobial performance and then the ratio of the sum of the total syndetics to the cationic biocide can be adjusted to provide optimum performance of the formulation in terms of cleaning, fragrance oil solubilization, and antimicrobial efficacy.

Another benefit of the use of a hydrophilic syndetic and a hydrophobic syndetic in combination with the cationic quaternary ammonium biocides or cationic biguanide biocides is that an additional anionic base surfactant can be incorporated into the formulation without the precipitation of cationic biocide and anionic surfactant. Without being bound by theory, it is believed that the hydrophilic and hydrophobic syndetics act in the same manner as described above, but in this case they reduce the strong "amphiphilicity" or very strong, electrostatic "self-interaction" of the cationic biocide-anionic surfactant pair at the oil-water interface, typically the fragrance oil-water interface, in the formulation. Applicants have found, particularly in the case of ready to use natural compositions, that the addition of an anionic base surfactant to a system that contains hydrophilic and hydrophobic syndetics and a cationic biocide can be use to tune the antimicrobial efficacy of the formulation. For example, the efficacy of the biocide in killing both gram positive and gram negative bacteria can be advantageously affected, without the use of additional solvents or alcohols. The use of syndetics thus provides an additional, novel optimization parameter for the performance of natural or more sustainable ready to use compositions that reduce or eliminate germs with the same performance attributes expected by consumers (i.e. good cleaning, low filming/streaking, non-objectionable odor, mildness toward skin, etc.).

Interfacial Tension ("IFT")

One aspect of the invention involves tuning the IFT between the aqueous cleaning composition at use dilution and a suitable oil, representing the oily soil of interest. The tuning of the IFT can be achieved by selecting the appropriate ratio between the base surfactant(s) and the hydrophilic and hydrophobic syndetics. Canola oil has been found useful in representing the oily soils of significant concern to consumers in a variety of cleaning tasks, including laundering of garments and cleaning of dishes, tableware and the like. However, it is also contemplated that formulation of some natural cleaners in which the oily soil of interest could be significantly chemically different from canola oil could also specifically benefit from a tuning of the IFT via the use of hydrophilic and hydrophobic syndetics. In such cases, substitution of canola oil with a different model oil, for example, common motor oil, a mineral oil, etc. in the IFT experiments could readily be achieved by one skilled in the art. The formulations described herein below were diluted 1:1150 with water containing 100 ppm hardness for use as the aqueous phase in contact with the canola oil. Such a dilution rate corresponds to the usage rates of liquid laundry detergents with which consumers are familiar. The interfacial tensions were measured with a spinning drop tensiometer. Experimental aspects of spinning drop tensiometry have been described in A. W. Adamson and A. P. Gast: Physical Chemistry of Surfaces, $6^{th}$ ed. Wiley & Sons, Inc., New York, 1997. IFT values between the diluted formulations in hard water and the canola oil below 0.3 mN/m were found to be necessary in order for the formulations to exhibit good to excellent overall detergency performance on a wide variety of common stains a consumer might encounter on garments.

Those skilled in the art realize that the overall average surfactant mixture hydrophilicity has a direct influence on the IFT. In conventional compositions, if the surfactant mixture selected is too hydrophilic for a given oil of interest, the IFT increases, resulting in a decline in the detergency performance. Thus, a reduction in the hydrophilicity of the formulation is typically sought and an improvement in the detergency performance achieved. One of the novel features of the instant invention is that a new and surprising way becomes available to further reduce the IFT via the adjustment of the ratio between the base surfactant(s) and the total syndetic amphiphile(s). As a consequence, it is possible to decrease IFT of a formulation by increasing the concentration of the most hydrophilic component, the hydrophilic syndetic, which is in direct contrast to results obtained when the formulations contain ordinary surfactants and no syndetics. Applicants have also observed an additional benefit which, without being bound by theory, is believed to be due to the small molecular size of the hydrophilic syndetic amphiphiles used in the invention. The small hydrophilic syndetic molecules have high mobility in the aqueous environment, and consequently reach interfaces quickly and therefore achieve a rapid IFT reduction. It is believed that for improved detergency performance it is important to achieve not only a low equilibrium IFT below 0.3 mN/m, but also to achieve it quickly relative to the time scale of the particular cleaning application. Therefore, two key benefits provided by the invention are the low equilibrium IFT and the rapid IFT reduction, both of which help improve cleaning performance. These benefits can be realized by appropriately selecting the ratio of the syndetics and the base surfactant(s).

In one embodiment, the base surfactant, the hydrophilic syndetic and the hydrophobic syndetic reduce the interfacial tension between water and a canola oil below about 0.35 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.3 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.25 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.20 mN/m, as measured via spinning drop tensiometry at 25° C., in less than 15 minutes after contacting said composition with said canola oil.

Ratios

Certain ratios of components can further define the present invention. One measurement is to evaluate and analyze the ratio of the total syndetics:total base surfactant weight ratios. The term "total syndetics" refers to sum of the weight percentages of hydrophilic syndetics and hydrophobic syndetics in a composition. The term "total base surfactant" refers to the sum of the weight percentages of anionic surfactant, and any applicable nonionic, amphoteric or cationic surfactants in the composition. In one aspect of the invention, the total syndetics:total base surfactant weight ratio is between about 0.001 to about 1.0, or about 0.001 to about 0.9, or about 0.001 to about 0.8, or about 0.001 to about 0.7, or about 0.001 to about 0.6, or about 0.001 to about 0.5, or about 0.001 to about 0.4, or about 0.001 to about 0.3, or about 0.001 to about 0.2, or about 0.001 to about 0.1. If the total syndetics:total base surfactant weight ratio fall into any of disclosed ranges above, then the base surfactant, the hydrophilic syndetic and the hydrophobic syndetic reduce the interfacial tension between water and a canola oil below about 0.30 mN/m, as measured via spinning drop tensiometry at 25° C., in less than 15 minutes after contacting said composition with said canola oil.

Depending on the composition of the base surfactant or total base surfactant mixture selected, adjustment of the ratio of the hydrophilic to hydrophobic syndetic or syndetics may be necessary, in order to deliver the most rapid reduction in IFT between the aqueous solution and oil. The hydrophilic syndetic is the sum of weight percentages of hydrophilic syndetics in a composition. The hydrophobic syndetic is the sum of weight percentages of hydrophobic syndetics in a composition. In one aspect of the invention, the hydrophilic syndetic:hydrophobic syndetic weight ratio is between about 0.01 to about 3.0, or about 0.01 to about 2.5, or about 0.01 to about 2.0, or about 0.01 to about 1.5, or about 0.01 to about 1.0, or about 0.01 to about 0.9, or about 0.01 to about 0.8, or about 0.01 to about 0.7, or about 0.01 to about 0.6, or about 0.01 to about 0.5, or about 0.01 to about 0.4, or about 0.01 to about 0.3, or about 0.01 to about 0.2, or about 0.01 to about 0.1. If the hydrophilic syndetic:hydrophobic syndetic weight ratio fall into any of disclosed ranges above, then the surfactant, the hydrophilic syndetic and the hydrophobic syndetic reduce the interfacial tension between water and a canola oil below about 0.30 mN/m, as measured via spinning drop tensiometry at 25° C., in less than 15 minutes after contacting said composition with said canola oil.

Chelating Agents

One aspect of the invention is a 2-hydroxycarboxylic acid or mixture of 2-hydroxycarboxylic acids or derivatives. Examples of 2-hydroxycarboxylic acids include, but are not limited to, tartaric acid, citric acid, malic acid, mandelic acid, glycolic acid, and lactic acid. Polymeric forms of 2-hydroxycarboxylic acid, such as polylactic acid, may also be employed.

Another aspect of the invention is the use of gluconate as an organic chelating agent. Examples of gluconate include, but not limited to, sodium gluconate, potassium gluconate, lithium gluconate, zinc gluconate, ferrous gluconate, and mixtures thereof.

Another aspect of the invention is the use of chelating agents such as, but not limited to, salts of ethylenediamine tetraacetic acid ("EDTA salts"), trimethyl glycine ("TMG"), diethylene triamine pentaacetic acid ("DTPA"), glutamic acid-N,N-diacetate ("GLDA"), and [S,S]-Ethylenediamine-disuccinic acid ("EDDS"), Tiron, all of which, individually or collectively, can improve the stain removal performance of formulations containing a hydrophilic syndetic, a hydrophobic syndetic, and a base anionic surfactant package. It has been found that TMG is particularly useful in improving the storage stability of liquid formulations at lower temperatures, i.e., below 10 C. Thus, TMG is useful as a component of desirably high RCI that can replace synthetic adjuvants such as the alkanolamines, for example, mono-, di-, or triethanolamine in liquid formulations.

Suitable amino carboxylates chelating agents include ethanol-diglycines, disodium cocoyl glutamatic acid, and methyl glycine di-acetic acid (MGDA), both in their acid form, or in their alkali metal, ammonium, and substituted ammonium salt forms. Further carboxylate chelating agents for use herein include salicylic acid, aspartic acid, glutamic acid, glycine, malonic acid or mixtures and derivatives thereof.

The compositions contain substantially no additional organic chelating agents. Suitable compositions comprise chelating agents in concentrations of about 0.5 to about 10.0% by weight, or about 0.5 to about 5.0% by weight, or about 0.5 to about 4.0% by weight, or about 0.5 to about 3.0% by weight, or about 0.5 to about 2.0% by weight.

Solvent

The cleaning compositions can optionally contain limited amounts of organic solvents, such as ethanol, sorbitol, glycerol, propylene glycol, glycerol, 1,3-propanediol, and mixtures thereof. These solvents may be less than 10% of the composition; in more preferred embodiments, these solvents may be less than 5% of the composition. The incorporation of these solvents in cleaner formulations is quite useful for controlling aesthetic factors of the undiluted products, such as viscosity, and/or for controlling the stability of important adjuncts such as enzymes, and/or for controlling the stability of the undiluted formulations at temperatures significantly above or below ambient temperature. It is believed that the solvents mentioned above have essentially no role in the reduction of the IFT of the formulations, especially at the use dilutions used in the IFT measurements performed. Thus, it is also believed that these solvents have no significant effect on the cleaning performance of the formulations. The compositions preferably contain solvents from natural sources rather than solvents from synthetic petrochemical sources, such as glycol ethers, hydrocarbons, and polyalkylene glycols. Water insoluble solvents such as terpenoids, terpenoid derivatives, terpenes, terpenes derivatives, or limonene can be mixed with a water-soluble solvent when employed. Methanol and propylene glycol may be incidental components in the cleaning compositions.

The compositions should be free of other organic solvents (or only trace amounts of less than 0.5% or 0.1%) other than the ones already enumerated above including. The compositions should be free of the following alkanols: n-propanol, isopropanol, butanol, pentanol, and hexanol, and isomers thereof. The compositions should be free of the following diols: methylene glycol, ethylene glycol, and butylene glycols. The compositions should be free of pentose alcohols such as D-xylitol, D-arabitol and their isomers. The compositions should be free of aryl alcohols such as benzyl alcohol or phenoxyethanol and their derivatives. The compositions should be free of the following alkylene glycol ethers which include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. The compositions should be free of the following short chain esters which include, but are not limited to, glycol acetate, and cyclic or linear volatile methylsiloxanes. The composition should not contain any alkyl glycol ethers, alcohol alkoxylates, alkyl monoglycerolether sulfate, or alkyl ether sulfates.

Water

When the composition is an aqueous composition, water can be a predominant ingredient. The water should be present at a level of less than about 95 weight percent, preferably less than about 90 weight percent, more preferably less than about 80 weight percent, and most preferably, less than about 70 weight percent. Deionized or filtered water is preferred.

Fragrances

The cleaning compositions can contain a fragrance. In a preferred embodiment, the cleaning compositions contain fragrances containing essential oils, and especially fragrances containing d-limonene or lemon oil; or natural essential oils or fragrances containing d-limonene or lemon oil. Lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The essential oils may contain minor, non-essential amounts of hydrocarbon carriers. Suitably, the fragrance contains essential oil or lemon oil or d-limonene in the cleaning composition in an amount ranging from about 0.01 to about 5.0 weight percent, about 0.01 to about 4.0 weight percent, about 0.01 to about 3.0 weight percent, about 0.01 to about 2.0 weight percent, about 0.01 to about 1.0 weight percent, or about 0.01 to about 0.50 weight percent, or about 0.01 to about 0.40 weight percent, or about 0.01 to about 0.30 weight percent, or about 0.01 to about 0.25 weight percent, or about 0.01 to about 0.20 weight percent, or about 0.01 to about 0.10 weight percent, or about 0.05 to about 2.0 weight percent, or about 0.05 to about 1.0 weight percent, or about 0.5 to about 1.0 weight percent, or about 0.05 to about 0.40 weight percent, or about 0.05 to about 0.30 weight percent, or about 0.05 to about 0.25 weight percent, or about 0.05 to about 0.20 weight percent, or about 0.05 to about 0.10 weight percent.

Natural Thickener

The present compositions can also comprise an auxiliary nonionic or anionic polymeric thickening component, especially cellulose thickening polymers, especially a water-soluble or water dispersible polymeric materials, having a molecular weight greater than about 20,000. By "water-soluble or water dispersible polymer" is meant that the material will form a substantially clear solution in water at a 0.5 to 1 weight percent concentration at 25° C. and the material will increase the viscosity of the water either in the presence or absence of surfactant. Examples of water-soluble polymers which may desirably be used as an additional thickening component in the present compositions, are hydroxyethylcellulose, hydroxypropyl cellulose, hydroxypropyl methylcellulose, dextrans, for example Dextran purified crude Grade 2P, available from D&O Chemicals, carboxymethyl cellulose, plant exudates such as acacia, ghatti, and tragacanth, seaweed extracts such as sodium alginate, and sodium carrageenan. Preferred as the additional thickeners for the present compositions are natural polysaccharide or cellulose materials. Examples of such materials include, but are limited to, guar gum, locust bean gum, xanthan gum, and mixtures thereof. The thickeners are generally present in amounts of about 0.05 to about 2.0 weight percent, or about 0.1 to about 2.0 weight percent.

The present invention may contain an anti-redeposition polymer. Examples of anti-redeposition polymers of neutral or anionic charge include, but are not limited to, inulin, and derivatized inulin (i.e. carboxymethyl inulin), and guar, or anionically derivatized guar. In addition to preventing deposition of particulate soils onto fabric surface, anionic derivatives of inulin and guar are useful in the sequestration of certain ions, such as Ca++, present in hard water used for dilution of the formulations. In addition to sequestering ions, these polymers may also serve to prevent or delay the growth of calcium carbonate crystals when the formulations are diluted in hard water in use, and hence can prevent the encrustation of fabrics and/or hard surfaces such as glass with calcium carbonate crystals. Use of these polymers of desirably high RCI reduces or eliminates the need for other materials, such as phosphates, which are well known to be detrimental to the environment when released into waste water streams. Also suitable herein preferred is hydroxyethyl cellulose having a molecular weight of about 700,000. Derivatized saccharides and polysaccharides containing alkoxy groups derived from reaction with ethylene oxide, propylene oxide, or butylene oxide are not used, due to the possibility of contamination by certain undesirable materials such as 1,4 dioxane and/or undesirably low RCI.

The present invention may also contain a cationic polymer, to aid in greasy soil removal and/or as an anti-redeposition aid. The addition of cationic polymers to cleaning compositions for the improvement of greasy soil removal by laundry detergent formulations is known, for example in EP 1146110 A2. However, in formulating natural cleaners with desirably high RCI values, the addition of synthetic polymers derived from petrochemicals is significantly restricted. Many synthetic cationic polymers, although exhibiting acceptable toxicological profiles, do not exhibit acceptable biodegradation properties. In addition, it is desirable that the natural cleaner formulations do not contain trace amounts of materials, inherent to their route of manufacture, which could be carcinogens, mutagens, or irritants to consumers, or which contributes to an environmental burden of these materials upon use of the products.

A significant part of the cleaning performance of the formulations herein depends upon the rapid adsorption of the main surfactants and the hydrophilic and hydrophobic syndetics onto oily soils such as canola oil. In addition to the constraints mentioned above, the selection of any cationic polymers for use in the formulations must also ensure that interactions between the anionic surfactants and/or syndetics in the formulation do not inhibit adsorption onto oily soil surfaces. In fact, properly selected cationic polymers can actually enhance the adsorption of anionic syndetics or surfactants onto the oily soils through electrostatic interactions between the cationic groups of the polymers and the anionic headgroups of the surfactants or syndetics, leading to slightly reduced repulsion between the anionic headgroups at the oily soil-water interface. Improperly selected cationic polymers will, instead, cause the formation of precipitates and/or coacervates in the washing bath, which can drive adsorption of the polymers onto some surfaces, but which also negatively affect the kinetics of adsorption of the surfactants and/or syndetics onto the oily soil, decreasing cleaning performance. Applicants have found that the use of even low concentrations of homo- or copolymers of diallyl dimethyl ammonium chloride (so-called poly-(DADMAC) negatively affect the cleaning performance of the syndetic-based systems, and thus should not be used. Without being bound by theory, these polymers exhibit charge densities (for a DADMAC homopolymer, about 6.2 meg/gram) which are so large that the polymers successfully interact electrostatically with the anionic surfactants and/or syndetics of the present invention, significantly slowing, or eliminating the adsorption of these materials onto oily soils. Polymers such as the DADMAC derivatives or other synthetic, nitrogen-containing polymers such as poly (ethyleneimine) and its derivatives are also of undesirably low RCI, and hence negatively impact the RCI of formulations incorporating them, and are not preferred.

Applicants have found good cleaning performance when the cationic polymers used are cationically modified poly (saccharides) of charge density less than about 2 meq/gram. Some of these polymers are capable of thickening cleaning compositions, but in the present invention, the concentrations of these polymers used typically do not significantly increase the viscosity of liquid formulations. A nonlimiting example of suitable cationic polymers include the class of cationically modified guars known as guar hydroxypropyl trimonium chloride, for example the materials marketed by Aqualon (Hercules) as N-Hance®. A particularly useful grade of cationic guar is also marketed by Aqualon as Aquacat CG 581® and its relatives, since this material is relatively low molecular weight and thus does not thicken the formulations efficiently.

Dyes, Colorants, and Preservatives

The cleaning compositions optionally contain dyes, colorants and preservatives, or contain one or more, or none of these components. These dyes, colorants and preservatives can be natural (occurring in nature or slightly processed from natural materials) or synthetic. Natural preservatives include benzyl alcohol, potassium sorbate and bisabalol; sodium benzoate and 2-phenoxyethanol. Preservatives, when used, include, but are not limited to, mildewstat or bacteriostat, methyl, ethyl and propyl parabens, bisguanidine compounds (e.g. Dantagard and/or Glydant). The mildewstat or bacteriostat includes, but is not limited to, mildewstats (including non-isothiazolone compounds) including Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G. Dyes and colorants include synthetic dyes such as Liquitint® Yellow or Blue or natural plant dyes or pigments, such as a natural yellow, orange, red, and/or brown pigment, such as carotenoids, including, for example, beta-carotene and lycopene. The compositions can additionally contain fluorescent whitening agents or bluing agents.

Adjuncts

The cleaning compositions optionally contain one or more of the following adjuncts: enzymes such as protease, amylase, mannanase, and lipase, stain and soil repellants, lubricants, odor control agents, perfumes, builders, cobuilders/soil suspension polymers, such as the water-soluble random copolymers of styrene and acrylic acid, an example of which is Alcosperse 747, available from Akzo Nobel, co-surfactants, fragrances and fragrance release agents, reducing agents such as sodium sulfite, and bleaching agents. Builders include, but are not limited to, zeolites, sulfates, silicates and carbonates. Cobuilders/soil suspension polymers include but are not limited to, carboxy methyl cellulose, carboxylated polymers (inulin, starch, polysaccharide) and poly(aspartic acid). Co-surfactants include, but are limited to, saponins and alkylamide ethanolamines. Bleaching agents include, but are not limited to, perborate, percarbonate, persulfate, peroxides, activators, catalysts, and mixtures thereof. Other adjuncts include, but are not limited to, acids, pH adjusting agents, electrolytes, dyes and/or colorants, solubilizing materials, stabilizers, thickeners, defoamers, hydrotropes, cloud point modifiers, preservatives, and other polymers. Electrolytes, when used, include, calcium, sodium and potassium chloride. Optional pH adjusting agents include inorganic acids and bases such as sodium hydroxide, and organic agents such as monoethanolamine, diethanolamine, and triethanolamine. The use of amino acids, particularly arginine, as pH adjusting agents in ready to use formulations containing a biocide and a fatty acid as a hydrophobic syndetic is preferred. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. For compressed solid forms, a disintegrant, such as a swelling material (for example, cellulose, crosslinked cellulose, polymer, or clay) or a rapidly dissolving salt, may be included. For predosed liquids, a water soluble film can be used to contain a nonaqueous liquid or powder composition or combination thereof until dilution in water; such films are known in the art and may consist of polyvinyl alcohol, starches, celluloses, or derivatives of these materials. Bleaching agents, when used, include, but are not limited to, peracids, hypohalite sources, hydrogen peroxide, and/or sources of hydrogen peroxide, such as catalysts and activators. In a preferred embodiment, the present invention includes a builder such as ethylene-diamine disuccinate. The present invention may also include a disulfonated catechol (i.e. Tiron, or 1,2 dihydroxybenzene 3,5 disodium sulfonate).

In a suitable embodiment the compositions contain an effective amount of one or more of the following non-limiting enzymes: protease, lipase, amylase, cellulase, mannanase, pectinase and mixtures thereof. Suitable enzymes are available from manufacturers including, but not limited to, Novozymes® and Genencor®.

pH

The pH of the cleaning composition is measured at 10% dilution. The cleaning compositions can have a pH of between 7 and 13, between 2 and 13, or between 7 and 10, or between 7 and 9, or between 7.5 and 8.5.

Disinfectant or Sanitizer

In order to provide sanitization or disinfection of surfaces, the cleaning compositions preferably contain a biguanide compound. Biguanide antimicrobial compounds include salts of chlorhexidine, for example chlorhexidine gluconate ("CHG"), alexidine and the like, as well as salts of poly (hexamethylene biguanide), for example, polyhexamethylene biguanide hydrochloride ("PHMB hydrochloride"). Biguanide compounds are preferred due to their low skin and eye irritation, but the invention also contemplates the use of germicical, non-polymeric quaternary ammonium salts such as benzalkonium chlorides and/or substituted benzalkonium chlorides, di($C_6$-$C_{14}$)alkyl di short chain ($C_1$-$C_4$ alkyl and/or hydroxyl-alkl) quaternaryammonium salts, N-(3-chloroallyl) hexaminium chlorides, benzetho-nium chloride, methylbenzethonium chloride, cetylpyridinium chloride and other quaternary compounds such as dialkyldimethyl ammonium chlorides, alkyl dimethylbenzylammonium chlorides, dialkylmethyl-benzylmmonium chlorides, and mixtures thereof. When a germicidal agent is incorporated into the cleaner formulations at levels typically needed for efficacy, the entire formulation can still be considered natural by consumers or overall, more sustainable, since the RCI of the formulation can be adjusted, with the selection of the syndetics and surfactants described herein, to be above 0.75, preferably above 0.95. Meeting the consumer needs for improved safety of the disinfecting formulations coupled with reduced environmental impact is possible by combining the selection of an appropriate germicidal agent with a hydrophilic syndetic, hydrophobic syndetic and optionally, a base surfactant or mixture of base surfactants as described herein. The formulations herein show acceptable antimicrobial efficacy without the presence of soluble ions of metals such as silver, copper, and zinc, which are known to be useful in germicidal formulations, but which are also not always readily accepted by consumers as either natural or safe materials. Thus, the use of these soluble ions in the formulations described herein is not preferred. The formulations should be free of the antimicrobial agents: triclosan, p-chlorometaxylenol or iodine.

Surface Modifying Agents

Although the compositions contain surfactants which lower the surface energy during cleaning, the compositions generally contain no surface modifying agents, which provide a lasting modification to the cleaned surface. The surface modifying agents are generally polymers other than the cellulosic thickening polymers and the others mentioned above and provide spreading of the water on the surface or beading of water on the surface, and this effect is seen when the surface is rewetted and even when subsequently dried after the rewetting. Examples of surface modifying agents include polymers and co-polymers of N,N-dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides. Other examples include organosilanes and organosilicone polymers, hydrophobic amphoteric polymers, nanoparticles and hydrophobic organic polymers, such as waxes derived from petrochemicals.

Forms

The compositions of this invention may be of various forms, including but not limited to, aqueous liquids, nonaqueous liquids, gels, foams, powders, tablets, and sachets comprising a formulation within a water-soluble film.

Cleaning Substrate

The cleaning composition of the present invention can be used independently from or in conjunction with an absorbent and/or adsorbent material. For instance, the cleaning composition is formulated to be used in conjunction with a cleaning wipe, sponge (cellulose, synthetic, etc.), paper towel, napkin, cloth, towel, rag, mop head, squeegee, and/or other cleaning device that includes an absorbent and/or adsorbent material. The cleaning composition can be pre-loaded onto an absorbent and/or adsorbent material, post-absorbed and/or post-adsorbed by a material during use, and/or be used separately from an absorbent and/or adsorbent material. Hereinafter, the cleaning composition will be described in terms of its composition and/or in combination with a cleaning wipe. The cleaning composition will also be described in a ready to use liquid form; however, the cleaning composition can be formulated as a concentrate in liquid, semi-liquid or solid form, or be formulated for aerosol use.

The cleaning wipe, upon which the improved cleaning composition is loaded thereon, is made of an absorbent/adsorbent material. Typically, the cleaning wipe has at least one layer of nonwoven material. Nonlimiting examples of commercially available cleaning wipes that can be used include DuPont 8838, Dexter ZA, Dexter 10180, Dexter M10201, Dexter 8589, Ft. James 836, and Concert STD60LN. All of these cleaning wipes include a blend of polyester and wood pulp. Dexter M10201 also includes rayon, a wood pulp derivative. The loading ratio of the cleaning composition onto the cleaning wipe is about 2-5:1, and typically about 3-4:1. The cleaning composition is loaded onto the cleaning wipe in any number of manufacturing methods. Typically, the cleaning wipe is soaked in the improved cleaning composition for a period of time until the desired amount of loading is achieved. The cleaning wipe loaded with the improved cleaning composition provides excellent cleaning with little or no streaking/filming.

EXAMPLES

The compositions are simple, natural, high performance cleaning formulations with a minimum of essential natural ingredients. Competitive cleaners are either natural and inferior in performance or contain additional ingredients that make them non-natural, such as surfactants based on nonrenewable petrochemicals. Because preservatives, dyes and colorants are used in such small amounts, these may be synthetic and the entire composition may still be characterized as natural. Preferably, the compositions contain only natural preservatives, dyes, and colorants, if any.

Table I illustrates natural heavy duty cleaners of the invention. Table II illustrates less concentrated natural heavy duty cleaners of the invention. All numbers are in weight percent of active ingredients.

TABLE I

| Natural Heavy Duty | A | B | C | D | E | F |
|---|---|---|---|---|---|---|
| Sodium lauryl sulfate | 16.6 | | 5.7 | | 10.0 | |
| MES[1] | | 11.1 | | | | 10.0 |
| Glucopon ® 600UP[2] | | | | 5.0 | 10.0 | |
| Glucopon ® 425N[3] | 7.8 | 8.0 | 2.7 | | | |

TABLE I-continued

| Natural Heavy Duty | A | B | C | D | E | F |
|---|---|---|---|---|---|---|
| Ammonyx LMDO[4] | 1.9 | 2.0 | 0.7 | | | |
| Ammonyx LO[5] | | | | | | 10.0 |
| AG 6206[6] | 2.9 | 1.0 | 1.0 | 2.0 | | |
| AG 6202[7] | | | | | 0.5 | 1.0 |
| Oleic Acid | 1.5 | 5.0 | 1.0 | | 0.5 | 1.0 |
| Sodium Citrate dihydrate | 3.0 | 6.0 | 2.0 | 2.0 | 1.0 | 1.0 |
| Sodium gluconate | | | | 1.0 | | |
| Boric acid | 1.5 | 1.5 | 3.0 | 3.0 | | 0.5 |
| Ca chloride | 0.1 | 0.1 | 0.1 | 0.1 | | 0.1 |
| Propylene glycol | 7.0 | 5.0 | | | | |
| Ethanol | | | 2.0 | | 5.0 | 2.0 |
| Glycerol | | | 8.0 | 10.0 | | |
| 1,3-Propane diol | | | | | | |
| Protease | 0.6 | 1.0 | 0.2 | 0.2 | 1.0 | 1.0 |
| Amylase | 0.3 | 0.6 | | | | |
| Sodium sulfite | | | 0.05 | | | |
| Dye | | | | | 0.1 | 0.1 |
| Preservative | 0.1 | 0.1 | 0.1 | 0.1 | 0.1 | 0.1 |
| FWA | | | | | 0.05 | |
| Thickener | | | 0.1 | 0.05 | | |
| Fragrance | 0.5 | 0.2 | 0.2 | 0.15 | 7.5 | 9.0 |
| NaOH to pH | 8.5 | 8.5 | 8.5 | 8.5 | | |
| Water | balance | balance | balance | balance | balance | balance |

[1]ALPHA-STEP ® MC-48 from Stepan Company.
[2]Coco glucoside from Cognis.
[3]from Cognis.
[4]from Lonza.
[5]from Lonza.
[6]from Akzo.
[7]from Akzo.

TABLE II

| Natural Heavy Duty | G | H | I | J | K | L |
|---|---|---|---|---|---|---|
| Sodium lauryl sulfate | 16.9 | | | | 17.5 | |
| MES | | 11.1 | 14.0 | 14.0 | | |
| Glucopon ® 625N | | | 7.0 | 7.0 | | |
| Glucopon ® 425N | 8.0 | 8.0 | | | 8.0 | 4.0 |
| Ammonyx LMDO | 2.0 | 2.0 | | | | |
| AG 6206 | 3.0 | 1.0 | 3.0 | | | |
| Hexyl sulfate | | | | | 1.0 | 3.0 |
| Oleic Acid | | | 5.0 | 5.0 | | 0.5 |
| Glycerol monooleate | 1.5 | | | | | |
| Sorbitan monooleate | | 1.5 | | | 0.5 | |
| Sodium Citrate dihydrate | | | 6.0 | 6.0 | | |
| Ca chloride | | | 0.1 | 0.1 | | |
| NaCl | | | 1.0 | 1.0 | 1.0 | 0.5 |
| Propylene glycol | | | 5.0 | 5.0 | | |
| Glycerol | 1.0 | | | | | |
| 1,3-Propane diol | | 1.0 | | | 3.0 | 3.0 |
| Preservative | 0.1 | 0.1 | 0.1 | 0.1 | | |
| Fragrance | | 0.2 | | | 0.1 | 0.1 |
| NaOH to pH | 8.5 | 8.5 | 8.5 | 8.5 | 10.0 | 7.0 |
| Water | balance | balance | balance | balance | balance | balance |

Formula A was compared for laundry wash performance with a leading commercial liquid laundry detergent containing non-natural ingredients. Stain removal was tested by washing coffee, tea, red wine, chocolate pudding, and gravy stains applied to four replicates of 100% cotton fabric at water of 93° F. and 100 ppm hardness in a 12-minute wash cycle in a Whirlpool top-load washing machine and reflectance of the stains via the L, a, b scale was then converted to a stain removal percentage. Formula A was superior to commercial detergent on coffee, tea, red wine, chocolate pudding, and gravy.

Formula D was compared for pretreatment performance against a leading commercial pretreatment product containing non-natural ingredients. Formulas were evaluated in a wash study using hand applied stains on pre-scoured white cotton T-shirts. 5 mL of product was pipetted onto each stain, allowed to sit for 5 minutes, and then washed in hot water with Tide® liquid detergent and dried in a standard dryer. Formula D showed parity stain removal performance on several stains and was superior to the commercial pretreatment product on wine stain.

Table III illustrates the effect of the hydrophilic syndetic in lowering the interfacial tension (IFT) of the composition for improved performance. Interfacial tension of the formulations at use dilution in the presence of 100 ppm hardness against canola oil was measured using a spinning drop tensiometer at room temperature. Composition I with the hydrophilic syndetic AG6206 achieves a lower IFT at faster times than Composition J, which doesn't have AG6206, and much faster that the commercial detergent ALL®.

TABLE III

| | IFT, 2 min | IFT, 7 min | IFT 12 min |
|---|---|---|---|
| Compositon I | 0.20 | 0.18 | 0.22 |
| Composition J | 0.26 | 0.25 | 0.28 |
| All Detergent | 0.46 | 0.32 | 0.51 |

TABLE IV

Example formulations with LMDO and AG 6206

| Natural Heavy Duty | M | N | O | P |
|---|---|---|---|---|
| Sodium lauryl sulfate | 7.43 | 7.43 | 7.43 | 7.43 |
| MES | 7.65 | 7.65 | 7.65 | 7.65 |
| Glucopon ® 425N | 7.07 | 7.07 | 7.07 | 7.07 |
| Ammonyx LMDO | 4.46 | 2.48 | 3.63 | 4.62 |
| AG 6206 | 1.13 | 5.63 | 8.25 | 10.49 |
| Water | balance | balance | balance | balance |

TABLE IVa

Example formulations and interfacial tension (IFT, mN/m) with Canola oil at 25° C.

| Formulation | Total syndetic:Total base surfactant, weight ratio | Hydrophilic Syndetic:Hydrophobic syndetic Weight ratio | IFT @ 5 mins | IFT @10 mins | IFT @15 mins |
|---|---|---|---|---|---|
| M | 0.252 | 0.253 | 0.219 | 0.259 | 0.281 |
| N | 0.366 | 2.270 | 0.293 | 0.292 | 0.285 |
| O | 0.536 | 2.273 | 0.228 | 0.257 | 0.201 |
| P | 0.682 | 2.271 | 0.196 | 0.185 | 0.221 |

Table IV illustrates compositions in which an amido amine oxide is the hydrophobic syndetic and a $C_6$ alkyl polyglucoside is the hydrophilic syndetic. Table IVa illustrates compositions with a total syndetic:total base surfactant weight ratio between 0.252-0.682 produce an optimum reduction in the interfacial tension below 0.3 mN/m as measured via spinning drop tensiometry at 25° C., in less than 15 minutes after contacting the composition with said canola oil. Table IVa also illustrates compositions with a hydrophilic syndetic:hydrophobic syndetic weight ratio between 0.253-2.273 produce an optimum reduction in the interfacial tension below 0.3 mN/m as measured via spinning drop tensiometry at 25° C., in less than 15 minutes after contacting the composition with said canola oil. These data indicate that, surprisingly, the addition of a hydrophilic syndetic, when incorporated into formulations at the appropriate levels and ratios described, delivers a rapid decrease in IFT that is quite useful for boosting the detergency process. Those skilled in the art would realize that such a decrease is not expected nor achieved by utilizing a relatively more hydrophilic base surfactant package alone.

TABLE V

Example formulations with Oleic Acid

| Natural Heavy Duty | Q | R | S | T |
|---|---|---|---|---|
| Sodium lauryl sulfate | 7.43 | 7.43 | 7.43 | 7.43 |
| MES | 7.65 | 7.65 | 7.65 | 7.65 |
| Glucopon ® 425N | 7.07 | 7.07 | 7.07 | 7.07 |
| Ammonyx LMDO | 1.74 | 1.74 | 1.74 | 1.74 |
| AG 6206 | 2.66 | 2.66 | 2.66 | 2.66 |
| Oleic Acid | 0.00 | 0.50 | 1.00 | 5.00 |
| Water | balance | balance | balance | balance |

Table V illustrates compositions in which oleic acid and an amido amine oxide are the hydrophobic syndetics, and a $C_6$ alkyl polyglucoside is the hydrophilic syndetic. Table Va illustrates compositions with a total syndetic:total base surfactant weight ratio of 0.199 produce an optimum reduction in the interfacial tension below 0.3 mN/m as measured via spinning drop tensiometry at 25° C., in less than 15 minutes after contacting the composition with said canola oil. Table Va also illustrates that compositions with a hydrophilic syndetic: hydrophobic syndetic weight ratio between 0.395-1.533 produce an optimum reduction in the interfacial tension below 0.3 mN/m as measured via spinning drop tensiometry at 25° C., in less than 15 minutes after contacting said composition with said canola oil. This data also illustrate the surprising utility of adjustment of the ratios described above by changing the level of only one of the hydrophobic syndetics, even when the base surfactant mixture remains constant. Even though oleic acid, as a hydrophobic syndetic, might be thought to act by partitioning into the oil phase (here, the canola oil), when combined with a hydrophilic syndetic, a significant benefit in the extent and rapidity of the reduction of the IFT can be realized. In practice, work with formulations in which a limited number of materials with appropriate RCI values are to be used, and in which other aesthetic factors such as viscosity of the undiluted formulation, or stability of important adjuncts such as enzymes are to be simultaneously optimized, the adjustment of the extent of and rapidity of the reduction of IFT via adjustment of the ratios defined above, sometimes via changing only one of the syndetics, can be very useful.

TABLE VI

Example formulations with Span ® 20 (Sorbitan Monolaurate)

| Natural Heavy Duty | U | V | W | X |
|---|---|---|---|---|
| Sodium lauryl sulfate | 7.43 | 7.43 | 7.43 | 7.43 |
| MES | 7.65 | 7.65 | 7.65 | 7.65 |
| Glucopon ® 425N | 7.07 | 7.07 | 7.07 | 7.07 |

TABLE Va

Example formulations and interfacial tension (IFT, mN/m) with Canola oil at 25° C.

| Formulation | Total syndetic:total base surfactant weight ratio | Hydrophilic Syndetic:Hydrophobic syndetic Weight ratio | IFT @ 5 mins | IFT @10 mins | IFT @15 mins |
|---|---|---|---|---|---|
| Q | 0.199 | 1.533 | 0.231 | 0.239 | 0.242 |
| R | 0.199 | 1.190 | 0.223 | 0.229 | 0.226 |
| S | 0.199 | 0.973 | 0.215 | 0.225 | 0.219 |
| T | 0.199 | 0.395 | 0.169 | 0.183 | 0.208 |

TABLE VI-continued

| Example formulations with Span ® 20 (Sorbitan Monolaurate) | | | | |
|---|---|---|---|---|
| Natural Heavy Duty | U | V | W | X |
| Ammonyx LMDO | 1.74 | 1.74 | 1.74 | 1.74 |
| AG 6206 | 2.66 | 2.66 | 2.66 | 2.66 |
| Span ® 20 (Sorbitan Monolaurate) | 0.00 | 0.55 | 1.40 | 2.00 |
| Water | balance | balance | balance | balance |

TABLE VIa

| Example formulations and interfacial tension (IFT, mN/m) with Canola oil at 25° C. | | | | | |
|---|---|---|---|---|---|
| Formulation | Total syndetic:total base surfactant weight ratio | Hydrophilic Syndetic:Hydrophobic syndetic Weight ratio | IFT @ 5 mins | IFT @ 10 mins | IFT @ 15 mins |
| U | 0.199 | 1.533 | 0.231 | 0.239 | 0.242 |
| V | 0.223 | 1.164 | 0.184 | 0.206 | 0.226 |
| W | 0.262 | 0.849 | 0.182 | 0.195 | 0.212 |
| X | 0.289 | 0.721 | 0.157 | 0.169 | 0.179 |

Table VI illustrates compositions in which sorbitan monolaurate and an amido amine oxide are the hydrophobic syndetics and $C_6$ alkyl polyglucoside is the hydrophilic syndetic. Table VIa illustrates compositions with a total syndetic:total base surfactant weight ratio between 0.199-0.289 produce an optimum reduction in the interfacial tension below 0.3 mN/m as measured via spinning drop tensiometry at 25° C., in less than 15 minutes after contacting the composition with said canola oil. Table VIa also illustrates compositions with a hydrophilic syndetic:hydrophobic syndetic weight ratio between 0.721-1.533 produce an optimum reduction in the interfacial tension below 0.3 mN/m as measured via spinning drop tensiometry at 25° C., in less than 15 minutes after contacting said composition with said canola oil.

TABLE VII

| Example formulations with Oleyl Alcohol | | |
|---|---|---|
| Natural Heavy Duty | Y | Z |
| Sodium lauryl sulfate | 7.43 | 7.43 |
| MES | 7.65 | 7.65 |
| Glucopon ® 425N | 7.07 | 7.07 |
| Ammonyx LMDO | 1.74 | 1.74 |
| AG 6206 | 2.66 | 2.66 |
| Oleyl Alcohol | 0.50 | 1.00 |
| Water | balance | Balance |

TABLE VIIa

| Example formulations and interfacial tension (IFT, mN/m) with Canola oil at 25° C. | | | | | |
|---|---|---|---|---|---|
| Formulation | Total syndetic:total base surfactant weight ratio | Hydrophilic Syndetic:Hydrophobic syndetic Weight ratio | IFT @ 5 mins | IFT @10 mins | IFT @15 mins |
| Y | 0.221 | 1.190 | 0.189 | 0.198 | 0.198 |
| Z | 0.244 | 0.973 | 0.216 | 0.205 | 0.205 |

Table VII illustrates compositions in which oleyl alcohol and an amido amine oxide are the hydrophobic syndetics and $C_6$ alkyl polyglucoside is the hydrophilic syndetic. Table VIIa illustrates compositions with a total syndetic:total base surfactant weight ratio between 0.221-0.244 produce an optimum reduction in the interfacial tension below 0.3 mN/m as measured via spinning drop tensiometry at 25° C., in less than 15 minutes after contacting the composition with said canola oil. Table VIIa also illustrates that compositions with a hydrophilic syndetic:hydrophobic syndetic weight ratio between 0.973-1.190 produce an optimum reduction in the interfacial tension below 0.3 mN/m as measured via spinning drop tensiometry at 25° C., in less than 15 minutes after contacting said composition with said canola oil.

TABLE VIII

Example formulations with Texapon ® 842 (a sodium octyl sulfate)

| Natural Heavy Duty | AA | BB | CC | DD |
|---|---|---|---|---|
| Sodium lauryl sulfate | 5.18 | 5.06 | 5.63 | 5.63 |
| MES | 6.24 | 6.24 | 6.94 | 6.94 |
| Glucopon ® 425N | 5.30 | 5.30 | 5.30 | 5.30 |
| Ammonyx LMDO | 1.30 | 1.30 | 1.30 | 1.30 |
| Span ® 20 (Soribitan Monolaurate) | 1.50 | 1.50 | 1.50 | 1.50 |
| Texapon ® 842 (Sodium Octyl Sulfate) | 0.00 | 0.30 | 0.90 | 1.74 |
| Calcium Chloride | 0.07 | 0.07 | 0.07 | 0.07 |
| Sodium Citrate Dihydrate | 2.24 | 2.24 | 2.24 | 2.24 |
| Boric Acid | 1.13 | 1.13 | 1.13 | 1.13 |
| Sodium Hydroxide to pH 8.5 | 0.37 | 0.37 | 0.37 | 0.37 |
| Sorbitol 70% in Water | 1.87 | 1.87 | 1.87 | 1.87 |
| Protease | 0.69 | 0.69 | 0.69 | 0.69 |
| Amylase | 0.36 | 0.36 | 0.36 | 0.36 |
| Water | balance | balance | balance | balance |

Table VIII illustrates compositions in which sodium octyl sulfate is the hydrophilic syndetic and an amido amine oxide and sorbitan monolaurate are the hydrophobic syndetics. Table VIIIa illustrates compositions with a total syndetic:total base surfactant weight ratio between 0.167-0.254 produce an optimum reduction in the interfacial tension below 0.3 mN/m as measured via spinning drop tensiometry at 25° C., in less than 15 minutes after contacting the composition with said canola oil. Table VIIIa also illustrates compositions with a hydrophilic syndetic:hydrophobic syndetic weight ratio between 0-0.621 produce an optimum reduction in the interfacial tension below 0.3 mN/m as measured via spinning drop tensiometry at 25° C., in less than 15 minutes after contacting said composition with said canola oil. The data also illustrate that a significant decrease in the IFT is achieved by increasing the concentration of the hydrophilic syndetic, which is a trend not expected or achieved through the use of base surfactant mixtures only, in the absence of a hydrophilic and hydrophobic syndetic.

TABLE IX

Example formulations with Texapon ® 842 (a sodium octyl sulfate)

| Natural Heavy Duty Cleaner | EE |
|---|---|
| Sodium lauryl sulfate | 6.75 |
| MES | 8.33 |
| Glucopon ® 425N | 7.07 |
| Ammonyx LMDO | 1.74 |
| Span ® 20 (Sorbitan Monolaurate) | 2.00 |
| Texapon ® 842 (Sodium Octyl Sulfate) | 1.20 |
| Calcium Chloride | 0.10 |
| Sodium Citrate Dihydrate | 2.99 |
| Boric Acid | 1.50 |
| Sodium Hydroxide to pH 8.5 | 0.50 |
| Sorbitol 70% in Water | 2.49 |
| Protease | 0.92 |
| Amylase | 0.48 |
| Water | balance |

TABLE VIIIa

Example formulations and interfacial tension (IFT, mN/m) with Canola oil at 25° C.

| Formulation | Total syndetic:Total base surfactant weight ratio | Hydrophilic Syndetic:Hydrophobic syndetic Weight ratio | IFT @ 5 mins | IFT @10 mins | IFT @15 mins |
|---|---|---|---|---|---|
| AA | 0.167 | 0 | 0.291 | 0.241 | 0.237 |
| BB | 0.187 | 0.107 | 0.198 | 0.196 | 0.184 |
| CC | 0.207 | 0.321 | 0.150 | 0.151 | 0.167 |
| DD | 0.254 | 0.621 | 0.211 | 0.167 | 0.197 |

TABLE IXa

Example formulations and interfacial tension (IFT, mN/m) with Canola oil at 25° C.

| Formulation | Total syndetic:total base surfactant weight ratio | Hydrophilic Syndetic:Hydrophobic syndetic Weight ratio | IFT @ 5 mins | IFT @10 mins | IFT @15 mins |
|---|---|---|---|---|---|
| EE | 0.223 | 0.321 | 0.197 | 0.200 | 0.200 |
| 2X Ultra Tide ® HE | — | — | 0.229 | 0.226 | 0.276 |

Table IX illustrates compositions in which Texapon® 842 (a sodium octyl sulfate) is the hydrophilic syndetic and sorbitan monolaurate and an amido amine oxide are the hydrophobic syndetics. Table IXa illustrates a composition with a total syndetic:total base surfactant weight ratio of 0.223 produces an optimum reduction in the interfacial tension below 0.3 mN/m as measured via spinning drop tensiometry at 25° C., in less than 15 minutes after contacting the composition with said canola oil. Table IXa also illustrates a composition with a hydrophilic syndetic:hydrophobic syndetic weight ratio 0.321 produces an optimum reduction in the interfacial tension below 0.3 mN/m as measured via spinning drop tensiometry at 25° C., in less than 15 minutes after contacting said composition with said canola oil. Table IXa also shows a lower IFT when formulation EE is compared with a synthetic (non-natural) detergent 2× Ultra Tide® HE at 5, 10 and 15 minute intervals.

TABLE X

Example formulations comprising a Single Anionic Surfactant in the Base Surfactant Mixture

| Natural Heavy Duty | FF | GG | HH | II | JJ |
|---|---|---|---|---|---|
| Sodium lauryl sulfate | 16.91 | 14.37 | 14.37 | 0.00 | 0.00 |

TABLE X-continued

Example formulations comprising a Single Anionic Surfactant in the Base Surfactant Mixture

| Natural Heavy Duty | FF | GG | HH | II | JJ |
|---|---|---|---|---|---|
| MES | 0.00 | 0.00 | 0.00 | 11.10 | 11.10 |
| Glucopon ® 425N | 8.00 | 6.80 | 6.80 | 8.00 | 8.00 |
| Ammonyx LMDO | 1.98 | 1.68 | 1.68 | 1.98 | 1.98 |
| AG 6206 | 3.00 | 2.55 | 2.55 | 0.98 | 0.98 |
| Calcium Chloride | 0.10 | 0.10 | 0.10 | 0.10 | 0.10 |
| Sodium Citrate Dihydrate | 3.00 | 3.00 | 3.00 | 6.00 | 6.00 |
| Boric Acid | 1.50 | 1.50 | 1.50 | 1.50 | 1.50 |
| Sodium Hydroxide to pH 8.5 | 0.50 | 0.50 | 0.50 | 0.50 | 0.50 |
| Oleic Acid | 1.50 | 1.28 | 1.28 | 5.00 | 5.00 |
| Sorbitol 70% in Water | 0.00 | 0.00 | 3.00 | 0.00 | 2.50 |
| Protease | 0.51 | 0.00 | 0.00 | 0.00 | 0.00 |
| Amylase | 0.26 | 0.00 | 0.00 | 0.00 | 0.00 |
| Ethanol | 0.00 | 3.00 | 3.00 | 2.50 | 2.50 |
| Glycerol | 0.00 | 3.00 | 0.00 | 2.50 | 0.00 |
| Propyelene Glycol | 7.00 | 0.00 | 0.00 | 0.00 | 0.00 |
| Preservative | 0.10 | 0.03 | 0.10 | 0.10 | 0.10 |
| Fragrance | 0.50 | 0.50 | 0.50 | 0.50 | 0.50 |
| Water | balance | balance | balance | balance | balance |

TABLE Xa

Example formulations and interfacial tension (IFT, mN/m) with Canola oil at 25° C.

| Formulation | Total Hydrophilic + Hydrophobic Syndetic/Total Base Surfactant | Hydrophilic Syndetic:Hydrophobic syndetic Weight ratio | IFT @ 5 min. | IFT @ 10 min. | IFT @ 15 min. |
|---|---|---|---|---|---|
| FF | 0.260 | 0.862 | 0.138 | 0.132 | 0.132 |
| GG | 0.260 | 0.862 | 0.117 | 0.115 | 0.100 |
| HH | 0.260 | 0.862 | 0.086 | 0.113 | 0.131 |
| II | 0.416 | 0.140 | 0.220 | 0.206 | 0.21 |
| JJ | 0.416 | 0.140 | 0.170 | 0.158 | 0.160 |

Table X illustrates compositions comprising a single anionic surfactant (either sodium lauryl sulfate or MES) in the base surfactant mixture comprising the anionic and a non-ionic alkyl glucoside (Glucopon® 425N). Table Xa illustrates compositions with a total syndetic:total base surfactant weight ratio between 0.260-0.416 produce an optimum reduction in the interfacial tension below 0.3 mN/m as measured via spinning drop tensiometry at 25° C., in less than 15 minutes after contacting the composition with said canola oil. Table Xa also illustrates compositions with a hydrophilic syndetic:hydrophobic syndetic weight ratio between 0.140-0.862 produce an optimum reduction in the interfacial tension below 0.3 mN/m as measured via spinning drop tensiometry at 25° C., in less than 15 minutes after contacting said composition with said canola oil.

TABLE XI

Formulations with Anionically Modified Inulin

| | Formulation | | | |
|---|---|---|---|---|
| | KK | LL | MM | NN |
| Sodium Lauryl Sulfate | 5.63 | 5.63 | 5.63 | 5.63 |

TABLE XI-continued

Formulations with Anionically Modified Inulin

| | Formulation | | | |
|---|---|---|---|---|
| | KK | LL | MM | NN |
| Glucopon ® 425N | 5.30 | 5.30 | 5.30 | 5.30 |
| MES | 6.94 | 6.94 | 6.94 | 6.94 |
| Ammonyx LMDO | 1.30 | 1.30 | 1.30 | 1.30 |
| Span 20 | 1.5 | 1.5 | 1.5 | 1.5 |
| Texapon 842 | 0.9 | 0.9 | 0.9 | 0.9 |
| Calcium Chloride | 0.1 | 0.1 | 0.1 | 0.1 |
| Boric Acid | 1.5 | 1.5 | 1.5 | 1.5 |
| Anionic Inulin (Dequest PB 11620) | 0.0 | 0.51 | 3.91 | 6.12 |
| Sodium Hydroxide | 0.5 | 0.5 | 0.5 | 0.5 |
| Sorbitol | 2.49 | 2.49 | 2.49 | 2.49 |
| DI Water | Balance | Balance | balance | balance |

TABLE XIa

Example Formulations and Interfacial Tension (IFT mN/m) with Canola Oil, 25° C.

| Formulation | Total Hydrophilic + Hydrophobic Syndetic/Total Base Surfactant | Hydrophilic Syndetic:Hydrophobic syndetic Weight ratio | IFT @ 5 min. | IFT @ 10 min. | IFT @ 15 min. |
|---|---|---|---|---|---|
| KK | 0.207 | 0.321 | 0.24 | 0.138 | 0.087 |
| LL | 0.207 | 0.321 | 0.234 | 0.127 | 0.091 |
| MM | 0.207 | 0.321 | 0.224 | 0.107 | 0.133 |
| NN | 0.207 | 0.321 | 0.252 | 0.156 | 0.086 |

Table XIa illustrates compositions with a total syndetic: total base surfactant weight ratio of 0.207 produce a reduction in the interfacial tension below 0.3 mN/m as measured via spinning drop tensiometry at 25° C., in less than 15 minutes after contacting the compositions with said canola oil, even though the compositions contain varying amounts of the anionically modified inulin. Table XIa also illustrates compositions with a hydrophilic syndetic:hydrophobic syndetic weight ratio of 0.321 produce a reduction in the interfacial tension below 0.3 mN/m as measured via spinning drop tensiometry at 25° C., in less than 15 minutes after contacting said composition with said canola oil. Thus, anionically modified inulin can be incorporated over a wide range of concentrations into the formulations containing syndetics, in order to deliver cleaning compositions with varying degrees of robustness toward calcium carbonate encrustation and/or deposition. Such formulations can be useful as liquid laundry products or dish cleaning products.

The compositions of this invention may be of various forms, including (but not restricted to) aqueous liquids, non-aqueous liquids, gels, foams, powders, tablets, and sachets comprising a formulation within a water-soluble film. Mixtures of forms (for example, solid particles within a liquid matrix, or encapsulated liquids within a solid or liquid matrix) are within the scope of the invention as well. Such examples are listed in Table XII.

TABLE XII

| Ingredient | OO | PP | QQ | RR | SS | TT | UU | VV |
|---|---|---|---|---|---|---|---|---|
| Product form | Aq liq. | Aq. Liq. | Nona qLiq. | Gel | Foam* | Powder | Tablet | Sachet |
| Sodium methyl ester sulfonate | 7.5 | | | | | | | |
| Sodium lauryl sulfate | 7.5 | 3.5 | 12.8 | 3.0 | 15.0 | 10.0 | 10.0 | 12.8 |
| Sodium octyl sulfate | | 3.0 | 2.5 | 1.0 | 1.0 | 2.0 | 2.0 | 2.5 |
| $C_8$-$C_{10}$ alkyl polyglucoside | 7.0 | 7.0 | | 7.0 | 5.0 | | | |
| $C_{12}$ alkyl polyglucoside | | 7.0 | | | | 5.0 | 6.0 | |
| $C_6$ alkyl polyglucoside | 2.7 | | | | | | | |
| Oleic acid | 3.0 | 3.0 | 12.7 | 1.0 | | 1.5 | 2.5 | 12.7 |
| Polyglycerol ether ($C_{14}$, 10 glycerin units) | | | 38.2 | | | | | 38.2 |
| Lauryl/myristyl ami-dopropyl amine oxide | 1.7 | | | | 2.0 | | | |
| C18 polypentoside | | 1.0 | | | | | | |
| Calcium chloride | | | | | | | | |
| Sodium chloride | | | | | | | | |
| Glycerol | | | 25.5 | 5.0 | 10.0 | | | 25.0 |
| Sodium silicate | | | | | | 5.0 | | |
| Sodium carbonate | | | | | | 30.0 | 30.0 | 0.5* |
| Sodium sulfate | | | | | | 25.0 | 20.0 | |
| Sodium citrate | 1.0 | | 7.6 | 2.0 | 1.0 | | | 7.6 |
| Sodium gluconate | | 1.0 | | | | | | |
| Zeolite A | | | | | | 20.0 | 20.0 | |
| Xanthan gum | | | | 0.5 | | | | |
| Clay | | | | | | | 3.0 | |
| Water-soluble film | | | | | | | | As needed |
| Fragrance | 0.5 | 0.5 | 0.5 | 0.5 | 0.5 | 0.5 | 0.5 | |
| Preservative | 0.1 | 0.1 | | 0.1 | 0.1 | | | |
| Sodium, potassium, or ammonium hydroxide (to desired pH) | | | | | | | | |
| Water (deionized) | To 100% | To 100% | — | To 100% | To 100% | — | — | — |

*as suspended speckle

Note that in examples OO and PP, an organic solvent is not required.

In Table XIII, an example formulation is disclosed wherein one added alkyl polyglucoside with a $C_8$-$C_{14}$ alkyl chain distribution serves as both the hydrophilic syndetic and the nonionic surfactant.

TABLE XIII

| Ingredient | Weight % |
|---|---|
| Sodium lauryl sulfate | 15.0% |
| $C_8$-$C_{14}$ alkyl polyglucoside | 5.0% |
| Lauryl dimethyl amine oxide | 4.0% |
| Ethanol | 1.0% |
| Glycerin | 3.5% |
| Citric Acid or Sodium Citrate | To desired pH |
| Preservative | 0.1% |
| Fragrance | 0.4% |
| Deionized water | To 100% |

Table XIV illustrates some ready to use cleaning compositions suitable for use as is, which is delivered from a package including a bottle and trigger sprayer, or delivered from a nonwoven substrate.

| Ingredient | WW | XX | YY | ZZ |
|---|---|---|---|---|
| Chlorhexidine digluconate | 0.12 | 0.12 | 0.12 | 0.12 |
| $C_8$-$C_{10}$ alkyl polyglucoside (Alkadet ® 15) | 0.56 | | | |
| $C_{12}$-$C_{16}$ alkyl polyglucoside (Glucopon ® 600UP) | 0.14 | | | |
| $C_8$-$C_{12}$ alkyl polyglucoside (Glucopon ® 215) | | 0.525 | | |
| $C_{12}$ amine oxide | | 0.175 | | |
| $C_8$-$C_{10}$ alkyl polypentoside (Radia ® Easysurf 6781) | | | 0.49 | 0.35 |
| Decaglyceryl monooleate (polyAldo 10-1-0 ® KFG) | | | 0.21 | |

-continued

| Ingredient | WW | XX | YY | ZZ |
|---|---|---|---|---|
| $C_{10}$-$C_{12}$ alkyl polypentoside (Radia ® Easysurf 6726) | | | | 0.35 |
| Fragrance | 0.15 | 0.15 | 0.15 | 0.15 |
| Water | to 100% | to 100% | to 100% | to 100% |

Notes

Alkadet ® 15, Glucopon ® 215, and Radia ® Easysurf 6781 are sources of both the hydrophilic syndetic and nonionic base surfactant.

Formulation WW thus illustrates a natural ready to use cleaner containing a biguanide biocide with a hydrophilic syndetic and a nonionic base surfactant that can solubilize a significant amount of a fragrance oil without the need for additional solvents.

Formulation XX illustrates a natural ready to use cleaner containing a biguanide biocide, a polyglucoside that is a source of both a hydrophilic syndetic and a nonionic base surfactant, and an amine oxide as a hydrophobic syndetic that can solubilize the same fragrance oil, with the need for additional solvents.

Formulation YY illustrates a natural ready to use cleaner containing a biguanide biocide, a polypentoside that is a source of both a hydrophilic syndetic and a nonionic base surfactant, and a fatty acid polyglycerol ester as the hydrophobic syndetic that can solubilize the same fragrance oil, without the need for additional solvents.

Formulation ZZ illustrates a natural ready to use cleaner containing a biguanide biocide, a first polypentoside that is a source of both a hydrophilic syndetic and a nonionic base surfactant, and a second polypentoside that serves as a nonionic base surfactant that can solubilize the same fragrance oil, without the need for additional solvents.

Table XV illustrates the aesthetic performance of the ready to use compositions. Clean mirrors treated with above formulations were randomly placed on a table and the appearance of the residues on them was judged by a trained panel. "Residue" can be defined as either soil and/or formulation residue remaining after cleaning, and is sometimes referred to as "filming and streaking". The residue levels from the cleaning formulations on the mirror surfaces were scored in comparison to clean mirror surface and a high residue control. The data indicate that natural cleaners which contain a biguanide biocide and no additional solvents, employing the approach of using a hydrophilic syndetic and a hydrophobic syndetic with a nonionic base surfactant yield filming and streaking aesthetic scores that are quite low and acceptable, even in comparison to other natural cleaners that lack at least one of the syndetics.

| Formulation | Clean surface | WW | XX | YY | ZZ | High residue control |
|---|---|---|---|---|---|---|
| Panel test results | 0 | 0.5 ± 0.8 | 7.9 ± 5.6 | 2 ± 2.3 | 2.5 ± 1.7 | 60 |

Table XVI illustrates the aesthetic performance of the ready to use compositions, as evaluated via an instrumental image analysis method. The treated mirrors were scanned under simulated sun-light and the mean gray value of the residues on mirrors was calculated based on the correlation of residue and mean grey value. The data in Table XVI confirm the similarity and acceptability of the aesthetic performance of the same formulations as in Table XV, as measured instrumentally.

TABLE XVI

| Formulation | Clean surface | WW | XX | YY | ZZ | High residue control |
|---|---|---|---|---|---|---|
| Imaging analytical results | 17.1 | 21.7 ± 0.7 | 23.9 ± 0.5 | 35.1 ± 5.0 | 28.2 ± 4.6 | 146.8 |

Table XVII illustrates some ready to use disinfecting compositions suitable for use as is, delivered from a package including a bottle and trigger sprayer, or delivered from a nonwoven substrate.

TABLE XVII

| Ingredient | AAA | BBB | CCC |
|---|---|---|---|
| Sodium lauryl sulfate | 0.13 | 0.14 | 0.13 |
| Chlorhexidine | 0.5 | 0.5 | 0.5 |
| $C_8$-$C_{10}$ alkyl polyglucoside (Alkadet ® 15) | 0.8 | | |
| $C_{12}$-$C_{16}$ alkyl polyglucoside (Glucopon ® 600UP) | 0.2 | | |
| C12 amine oxide | | 0.2 | |
| $C_8$-$C_{10}$ alkyl polypentoside (Radia ® Easysurf 6781) | | 0.8 | 0.8 |
| $C_{10}$-$C_{12}$ alkyl polypentoside (Radia ® Easysurf 6726) nonionic surfactant | | | 0.2 |
| Water | to 100% | to 100% | to 100% |
| pH | 9 | 9 | 5.7 |

Notes

Alkadet ® 15 and Radia ® Easysurf 6781 are sources of both the hydrophilic syndetic and nonionic base surfactant.

Formulation AAA illustrates a natural cleaner that contains a hydrophilic syndetic and a mixture of an anionic base surfactant and a nonionic polyglucoside surfactant that surprisingly yields a clear, one phase, stable solution with CHG used as a biocide and cationic base surfactant, at pH greater than 7, without the need for additional alcohol or solvents.

Formulation CCC illustrates a natural cleaner that contains a hydrophilic syndetic (delivered via a complex polypentoside) and a mixture of an anionic base surfactant and a nonionic polypentoside base surfactant system that surprisingly yields a clear, one phase, stable solution with CHG used as a biocide and cationic base surfactant at pH less than 7, without the need for additional alcohol or solvents.

Formulation BBB illustrates a natural cleaner that contains a hydrophilic syndetic (delivered via a complex polypentoside), and a mixture of an anionic base surfactant and a nonionic polypentoside (delivered via a complex polypentoside) base surfactant system, and a hydrophobic syndetic that surprisingly yields a clear, one phase, stable solution with CHG used as a biocide and a cationic base surfactant, without the need for additional alcohol or solvents.

Table XVIII illustrates the antimicrobial performance of the ready to use disinfecting compositions. In a multiwell plate, 185 microliters of each composition was added to a suspension of *Staph. Aureus* bacteria ($5\times10^5$ cfu). After 2 minutes, the antimicrobial action of the CHG was stopped via the addition of a neutralizer solution. The plate was then incubated at 35 C for 24 hours. The viability of organisms was determined via the turbidity (at 600 nm) in each well. Out of 40 replicates, the number of replicates with surviving bacteria was counted and converted to a % positive score. Better antimicrobial activity corresponds to a lower % positive score. The data in Table XVIII show that the antimicrobial performance of the natural ready to use cleaner formulation BBB is at least comparable to the other formulations, which lack one of the syndetic components. Surprisingly, the antimicrobial activity of CHG is acceptable, even in the presence of an anionic base surfactant, and even in the absence of other solvents or alcohols. The positive efficacy control sample represents a typical formulation known to the art to have good performance, and contains 0.2% CHG, 70.5% ethanol, and 29.3% water. The differences between the percent positive scores of formulations AAA, BBB, CCC and the positive efficacy control were not statistically significant.

TABLE XVIII

| Formulation | Negative Efficacy Control | AAA | BBB | CCC | Positive Efficacy Control |
|---|---|---|---|---|---|
| Antimicrobial efficacy, % positive | 100% | 3% | 3% | 2% | 0% |

Table XVIV illustrates some ready to use disinfecting compositions suitable for use as is, delivered from a package including a bottle and trigger sprayer, or delivered from a nonwoven substrate.

TABLE XVIV

| Ingredient | DDD | EEE | FFF | GGG | HHH |
|---|---|---|---|---|---|
| Chlorhexidine digluconate | 0.5 | 0.5 | 0.5 | 0.5 | 0.5 |
| C4-8 polypentoside (Radia ® Easysurf 6505) | 0.12 | 0.12 | 0.24 | 0.24 | 0.24 |
| C12 amine oxide (Ammonyx LO) | 0.168 | 0.18 | 0.06 | 0.06 | 0.06 |
| Sodium dihexyl sulfosuccinate | 0.022 | | | | |
| Coconut fatty acids | | 0.012 | | | |
| L-arginine (amino acid pH adjuster) | | 0.01 | | 0.04 | |
| Octyl pyrrolidone | | | 0.057 | 0.11 | |
| Monoethanolamine (pH adjuster) | 0.017 | 0.017 | 0.017 | 0.017 | 0.017 |
| Fragrance | 0.15 | 0.15 | 0.15 | 0.15 | 0.15 |
| Water | to 100 | to 100 | to 100 | to 100 | to 100 |

All of the formulations summarized in Table XVIV are examples of natural disinfecting cleaners that are relatively low in actives levels, and are useful as ready to use lotions that can be delivered from a nonwoven substrate. None of these formulations requires additional solvents or alcohol to achieve both antimicrobial efficacy of the CHG combined with very low filming/streaking properties. All of the formulations provide stable, one phase solutions with CHG, without the need for additional solvents or alcohol. Formulation DDD illustrates the use of a hydrophilic syndetic, a hydrophobic syndetic, an anionic base surfactant and CHG as a biocide and cationic base surfactant. Formulation EEE illustrates the use of a hydrophilic syndetic, and a mixture of two hydrophobic syndetics and CHG as a biocide and cationic base surfactant. Formulation FFF illustrates the use of CHG as a biocide and cationic base surfactant, a hydrophilic syndetic, a hydrophobic syndetic, and a nonionic base surfactant (octyl pyrrolidone) that is particularly useful in optimizing both the aesthetic and the antimicrobial performance of the natural disinfecting cleaner. Formulation GGG illustrates the use of CHG as a biocide and cationic base surfactant, a hydrophilic syndetic, a hydrophobic syndetic and the nonionic base surfactant octyl pyrrolidone together with L-arginine amino acid as a pH adjuster that is also advantageous for antimicrobial efficacy of the CHG biocide. Formulation HHH illustrates the use of CHG as a biocide and cationic base surfactant, a hydrophilic syndetic, and a hydrophobic syndetic that can solubilize the same amount of the same fragrance as the other formulations, and which is especially suitable for use as a lotion delivered from a nonwoven that could be a combination of a surface cleaner and hand sanitizer, due to the superior filming/streaking, the efficacy of the CHG, and the preferred handfeel due to the lack of any harsh solvents or alcohol, (which can dry the skin), but which also does not necessarily require the addition of an emollient to increase consumer acceptance.

Table XX illustrates the antimicrobial performance of the ready to use disinfecting compositions. In a multiwell plate, 185 microliters of each composition was added to a suspension of *Staph. Aureus* bacteria ($5\times10^5$ cfu). After 1 minute, the antimicrobial action of the CHG was stopped via the addition of a neutralizer solution. The plate was then incubated at 35° C. for 24 hours. The viability of organisms was determined via the turbidity (at 600 nm) in each well. Out of 40 replicates, the number of replicates with surviving bacteria were counted and converted to a % positive score. Better antimicrobial activity corresponds to a lower % positive score. The positive efficacy control sample represents a typical formulation known to the art to have good performance, and contains 0.2% CHG, 70.5% ethanol, and 29.3% water.

TABLE XX

| Formulation | Negative Efficacy Control | DDD | EEE | FFF | GGG | HHH | Positive Efficacy Control |
|---|---|---|---|---|---|---|---|
| Antimicrobial efficacy, % positive | 100% | 3.3% | 0.8% | 2.1% | 0% | 3.3% | 0.8% |

Table XXI illustrates formulations some ready to use disinfecting hand sanitizers suitable for use as is, delivered from a package including a bottle and trigger sprayer, foam sprayer, or delivered from a nonwoven substrate.

All of the formulations summarized in Table XXI are examples of natural cleaning compositions that are relatively low in actives levels, and are useful as ready to use lotions, or as ready to use lotions that can be delivered from a nonwoven substrate. None of these formulations requires additional solvents or alcohol to achieve both antimicrobial efficacy of the CHG combined with very low filming/streaking properties. All of the formulations provide stable, one phase solutions with CHG, without the need for additional solvents or alcohol. Formulation III illustrates the use of a hydrophilic syndetic, and a mixture of two hydrophobic syndetics and CHG as a biocide and cationic base surfactant. Formulation JJJ illustrates the use of CHG as a biocide and cationic base surfactant, a hydrophilic syndetic, a hydrophobic syndetic and the nonionic base surfactant octyl pyrrolidone that can optimize both aesthetics and antimicrobial performance of the CHG biocide. Formulation KKK illustrates the use of CHG as a biocide and cationic base surfactant, a hydrophilic syndetic, and a hydrophobic syndetic that can solubilize the same amount of the same fragrance as the other formulations, and which is especially suitable for use as a lotion delivered from a nonwoven that could be a combination of a surface cleaner and hand sanitizer, due to the superior filming/streaking, the efficacy of the CHG, and the preferred handfeel due to the lack of any harsh solvents or alcohol, (which can dry the skin), but which also does not necessarily require the addition of an emollient to increase consumer acceptance.

TABLE XXI

| Ingredient | III | JJJ | KKK |
|---|---|---|---|
| Chlorhexidine digluconate | 0.25 | 0.25 | 0.25 |
| C4-8 polypentoside (Radia ® Easysurf 6505) | 0.12 | 0.24 | 0.24 |
| C12 amine oxide (Ammonyx LO) | 0.168 | 0.06 | 0.06 |
| Coconut fatty acids | 0.012 | | |
| L-arginine (amino acid pH adjuster) | 0.01 | | |
| Octyl pyrrolidone | | 0.057 | |
| Monoethanolamine (pH adjuster) | 0.017 | 0.017 | 0.017 |
| Fragrance | 0.15 | 0.15 | 0.15 |
| Water | to 100 | to 100 | to 100 |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A natural composition consisting essentially of:

a. a hydrophilic syndetic selected from the group consisting of $C_6$ alkyl polyglucoside, $C_6$ to $C_8$ alkyl polyglucoside, $C_8$ alkyl polyglucoside, a $C_4$ to $C_8$ alkyl polypentoside and combinations thereof;

b. a hydrophobic syndetic selected from the group consisting of amine oxide, a fatty acid, a fatty alcohol, a sterol, a sorbitan fatty acid ester, a glycerol fatty acid ester, a polyglycerol fatty acid ester, a $C_{14}$ to $C_{22}$ alkyl polypentoside, and combinations thereof;

c. a biguanide compound or a cationic quaternary ammonium salt, or mixtures thereof;

d. a nonionic surfactant selected from a $C_8$ to $C_{10}$ alkyl polypentoside;

e. optionally an organic chelating agent from the group consisting of 2-hydroxyacids, 2-hydroxyacid derivatives, glutamic acid, glutamic acid derivatives, gluconate, and mixtures thereof;

f. optionally a solvent selected from the group consisting of propylene glycol, 1,3-propanediol, ethanol, sorbitol, glycerol and combinations thereof;

g. optionally an anionic surfactant selected from the group consisting of sodium lauryl sulfate, sodium alkyl α-sulfomethyl ester, and combinations thereof;

h. optional ingredients selected from pH adjusting agents, builders, calcium salts, boric acid or borate, enzymes, dyes, colorants, fragrances, preservatives, fluorescent whitening agents, bluing agents, defoamers, bleaches, thickeners, amino acids, monoethanolamine, alkyl pyrrolidone, $C_{10}$ to $C_{12}$ alkyl polypentoside, anti-redeposition polymers, salts of EDTA, DTPA, GLDA, EDDS, TMG, Tiron and combinations thereof.

2. The composition of claim 1, wherein the composition does not contain alkyl glycol ethers, alcohol alkoxylates, alkyl monoglycerolether sulfate, alkyl ether sulfates, alkanolamines, alkyl ethoxysulfates, phosphates, linear alkylbenzene sulfonate ("LAS"), linear alkylbenzene sulphonic acid ("HLAS") or nonylphenol ethoxylate ("NPE"), or soluble metal ions selected from the group of silver, copper, or zinc.

3. The composition of claim 1, wherein the composition does not contain a solvent selected from the group consisting of propylene glycol, 1,3-propanediol, ethanol, sorbitol, glycerol, n-propanol, isopropanol, butanol, pentanol, hexanol, methylene glycol, ethylene glycol, butylene glycol, D-xylitol, D-arabitol, benzyl alcohol, phenoxyethanol, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers and combinations thereof.

4. The composition of claim 1, wherein the composition requires an organic chelating agent selected from the group consisting of 2-hydroxyacids, 2-hydroxyacid derivatives, glutamic acid, glutamic acid derivatives, gluconate, and mixtures thereof.

5. The composition of claim 1, wherein the composition is a natural composition, wherein said natural composition has a) at least 95% of the components of the natural composition are derived from plant and mineral based materials;

b) the natural composition is biodegradable;

c) the natural composition is minimally toxic to humans;

d) the natural composition has a LD50>5000 mg/kg; and e) the natural composition does not contain non-plant based ethoxylated surfactants, linear alkylbenzene sulfonates, ether sulfates surfactants or nonylphenol ethoxylate.

6. The composition of claim 5, the composition is an ecofriendly composition, wherein said ecofriendly composition has a) at least 99% of the components of the ecofriendly composition are derived from plant and mineral based materials;

b) the ecofriendly composition is biodegradable;

c) the ecofriendly composition is minimally toxic to humans;

d) the ecofriendly composition has a LD50>5000 mg/kg; and e) the ecofriendly composition does not contain non-plant based ethoxylated surfactants, linear alkylbenzene sulfonates, ether sulfate surfactants or nonylphenol ethoxylate.

7. A natural composition consisting essentially of:

a. a hydrophilic syndetic selected from $C_4$ to $C_8$ alkyl polypentoside;

b. a hydrophobic syndetic selected from the group consisting of an amine oxide, a fatty acid, a fatty alcohol, a sterol, a sorbitan fatty acid ester, a glycerol fatty acid ester, a polyglycerol fatty acid ester, a $C_{14}$ to $C_{22}$ alkyl polypentoside, and combinations thereof;

c. a biguanide compound or a cationic quaternary ammonium salt, or mixtures thereof;

d. optionally, an organic chelating agent from the group consisting of 2-hydroxyacids, 2-hydroxyacid derivatives, glutamic acid, glutamic acid derivatives, gluconate and mixtures thereof;

e. optionally a solvent selected from the group consisting of propylene glycol, 1,3-propanediol, ethanol, sorbitol, glycerol and combinations thereof;

f. optionally a nonionic surfactant selected from the group consisting of an alkylpolyglucoside having chain lengths from $C_{10}$ to $C_{20}$, alkyldiethanolamide, alkylethanolamide, an alkyl (poly glycerol ether), a $C_8$ to $C_{14}$ alkyl polypentoside, an alkyl pyrrolidone having chain lengths $C_8$ and greater, and combinations thereof;

g. optionally, an anionic surfactant selected from the group consisting of a fatty alcohol sulfate, an alkyl a-sulfomethyl ester, an alkyl sulfosuccinate, and combinations thereof;

h. optionally an amphoteric surfactant selected from the group consisting of sarcosinate, tauride, betaine, sulfobetaine and combinations thereof; and i. optional ingredients selected from pH adjusting agents, calcium salts, boric acid, enzymes, dyes, colorants, fragrances, preservatives, fluorescent whitening agents, bluing agents, defoamers, bleaches, thickeners, amino acids, monoethanolamine, anti-redeposition polymers, salts of EDTA, DTPA, GLDA, EDDS, TMG, Tiron and combinations thereof.

8. The composition of claim 7, wherein the composition requires a nonionic surfactant selected from the group consisting of an alkylpolyglucoside having chain lengths from $C_{10}$ to $C_{20}$, alkyldiethanolamide, alkylethanolamide, an alkyl (poly glycerol ether), a $C_8$ to $C_{14}$ alkyl polypentoside, an alkyl pyrrolidone having chain lengths $C_8$ and greater, and combinations thereof.

9. The composition of claim 7, wherein the composition does not contain alkyl glycol ethers, alcohol alkoxylates, alkyl monoglycerolether sulfate, alkyl ether sulfates, alkyl ethoxysulfates, phosphates, linear alkylbenzene sulfonate ("LAS"), linear alkylbenzene sulphonic acid ("HLAS") or nonylphenol ethoxylate ("NPE") or soluble metal ions selected from the group of silver, copper, or zinc.

10. The composition of claim 7, wherein the composition is a natural composition, wherein said natural composition has a) at least 95% of the components of the natural composition are derived from plant and mineral based materials;
b) the natural composition is biodegradable;
c) the natural composition is minimally toxic to humans;
d) the natural composition has a LD50>5000 mg/kg; and
e) the natural composition does not contain non-plant based ethoxylated surfactants, linear alkylbenzene sulfonates, ether sulfates surfactants or nonylphenol ethoxylate.

11. The composition of claim 10, the composition is an ecofriendly composition, wherein said ecofriendly composition has a) at least 99% of the components of the ecofriendly composition are derived from plant and mineral based materials;
b) the ecofriendly composition is biodegradable;
c) the ecofriendly composition is minimally toxic to humans;
d) the ecofriendly composition has a LD50>5000 mg/kg; and
e) the ecofriendly composition does not contain non-plant based ethoxylated surfactants, linear alkylbenzene sulfonates, ether sulfates surfactants or nonylphenol ethoxylate.

12. The composition of claim 7, wherein the composition does not contain a solvent selected from the group consisting of propylene glycol, 1,3-propanediol, ethanol, sorbitol, glycerol, n-propanol, isopropanol, butanol, pentanol, hexanol, methylene glycol, ethylene glycol, butylene glycol, D-xylitol, D-arabitol, benzyl alcohol, phenoxyethanol, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers and combinations thereof.

13. The composition of claim 7, wherein the hydrophobic syndetic is a fatty acid and the fatty acid is a coconut fatty acid.

14. A natural composition comprising:

a. a hydrophilic syndetic selected from $C_4$ to $C_8$ alkyl polypentoside;
b. a hydrophobic syndetic selected from the group consisting of an amine oxide, a fatty acid, a fatty alcohol, a sterol, a sorbitan fatty acid ester, a glycerol fatty acid ester, a polyglycerol fatty acid ester, a $C_{14}$ to $C_{22}$ alkyl polypentoside, and combinations thereof;
c. a biguanide compound or a cationic quaternary ammonium salt, or mixtures thereof;
d. optionally a solvent selected from the group consisting of 1,3-propanediol, sorbitol, glycerol and combinations thereof;
e. optionally a nonionic surfactant selected from the group consisting of an alkylpolyglucoside having chain lengths from $C_8$ to $C_{20}$, alkyldiethanolamide, alkylethanolamide, an alkyl (poly glycerol ether), a $C_8$ to $C_{14}$ alkyl polypentoside, an alkyl pyrrolidone having chain lengths $C_8$ and greater, and combinations thereof;
f. optionally an amphoteric surfactant selected from the group consisting of sarcosinate, tauride, betaine, sulfobetaine and combinations thereof;
g. optionally, an anionic surfactant selected from the group consisting of a fatty alcohol sulfate, an alkyl a-sulfomethyl ester, an alkyl sulfosuccinate, and combinations thereof;
h. optionally an organic chelating agent from the group consisting of 2-hydroxyacids, 2-hydroxyacid derivatives, glutamic acid, glutamic acid derivatives, gluconate, and mixtures thereof; and
i. optional ingredients selected from pH adjusting agents, calcium salts, boric acid, enzymes, dyes, colorants, fragrances, preservatives, fluorescent whitening agents, bluing agents, defoamers, bleaches, thickeners, amino acids, monoethanolamine, anti-redeposition polymers, ethanol, propylene glycol, salts of EDTA, DTPA, GLDA, EDDS, TMG, Tiron, and combinations thereof, wherein the composition does not contain alkyl glycol ethers, alcohol alkoxylates, alkyl monoglycerolether sulfate, alkyl ether sulfates, alkyl ethoxysulfates, phosphates, linear alkylbenzene sulfonate ("LAS"), linear alkylbenzene sulphonic acid ("HLAS") nonylphenol ethoxylate ("NPE"), soluble metal ions selected from the group of silver, copper, or zinc, triclosan, p-chlorometaxylenol or iodine, pentose alcohols and their isomers, D-xylitol and its isomers, D-arabitol and its isomers, aryl alcohols, benzyl alcohol, phenoxyethanol, or homopolymers of the monomers diallyl dimethyl ammonium chloride or ethylene imine.

15. The composition of claim 14, wherein the composition requires a nonionic surfactant selected from the group consisting of an alkylpolyglucoside having chain lengths from $C_8$ to $C_{20}$, alkyldiethanolamide, alkylethanolamide, an alkyl (poly glycerol ether), a $C_8$ to $C_{14}$ alkyl polypentoside, an alkyl pyrrolidone having chain lengths $C_8$ and greater, and combinations thereof.

16. The composition of claim 14, wherein the composition is a natural composition, wherein said natural composition has a) at least 95% of the components of the natural composition are derived from plant and mineral based materials;
b) the natural composition is biodegradable;
c) the natural composition is minimally toxic to humans;
d) the natural composition has a LD50>5000 mg/kg; and
e) the natural composition does not contain non-plant based ethoxylated surfactants, linear alkylbenzene sulfonates, ether sulfates surfactants or nonylphenol ethoxylate.

17. The composition of claim 16, the composition is an ecofriendly composition, wherein said ecofriendly composition has a) at least 99% of the components of the ecofriendly composition are derived from plant and mineral based materials;
b) the ecofriendly composition is biodegradable;
c) the ecofriendly composition is minimally toxic to humans;
d) the ecofriendly composition has a LD50>5000 mg/kg; and
e) the ecofriendly composition does not contain non-plant based ethoxylated surfactants, linear alkylbenzene sulfonates, ether sulfates surfactants or nonylphenol ethoxylate.

18. The composition of claim 14, wherein the composition does not contain a solvent selected from the group consisting of propylene glycol, 1,3-propanediol, ethanol, sorbitol, glycerol, n-propanol, isopropanol, butanol, pentanol, hexanol, methylene glycol, ethylene glycol, butylene glycol, D-xylitol, D-arabitol, benzyl alcohol, phenoxyethanol, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers and combinations thereof.

* * * * *